US010806656B2

(12) United States Patent
Heyerdahl et al.

(10) Patent No.: US 10,806,656 B2
(45) Date of Patent: Oct. 20, 2020

(54) PATIENT ISOLATOR

(71) Applicant: OSLO UNIVERSITETSSYKEHUS HF, Oslo (NO)

(72) Inventors: Fridtjof Heyerdahl, Oslo (NO); Knut Erik Hovda, Oslo (NO); Espen Rostrup Nakstad, Oslo (NO); Arne Broch Brantsaeter, Hosle (NO); Ronald Rolfsen, Oslo (NO)

(73) Assignee: Oslo Universitetssykehus HF, Oslo (NO)

( * ) Notice: Subject to any disclaimer, the term of this patent is extended or adjusted under 35 U.S.C. 154(b) by 125 days.

(21) Appl. No.: 15/775,635

(22) PCT Filed: Nov. 14, 2016

(86) PCT No.: PCT/EP2016/077598
§ 371 (c)(1),
(2) Date: May 11, 2018

(87) PCT Pub. No.: WO2017/081322
PCT Pub. Date: May 18, 2017

(65) Prior Publication Data

US 2018/0303691 A1 Oct. 25, 2018

(30) Foreign Application Priority Data

Nov. 13, 2015 (GB) ..... 1520065.2

(51) Int. Cl.
*A61G 10/00* (2006.01)
*G21F 7/053* (2006.01)
(Continued)

(52) U.S. Cl.
CPC ..... *A61G 10/005* (2013.01); *A61G 1/04* (2013.01); *G21F 7/053* (2013.01); *A61G 1/00* (2013.01)

(58) Field of Classification Search
CPC ..... A61G 10/00; A61G 10/005; A61G 10/02; A61G 10/023; A61G 10/026; A61G 10/04; A61G 11/00; A61G 11/001–009
See application file for complete search history.

(56) References Cited

U.S. PATENT DOCUMENTS 2,104,589 A 1/1938 Hartman
D111,283 S 9/1938 Gellman
(Continued)

FOREIGN PATENT DOCUMENTS

CN 1539394 A 10/2004
CN 101843545 A 9/2010
(Continued)

OTHER PUBLICATIONS

Summary of Third Party Manufacturers of Patient Isolation Units, 10 pages, May 18, 2015.
(Continued)

*Primary Examiner* — Carrie R Dorna
(74) *Attorney, Agent, or Firm* — Fay Sharpe LLP

(57) ABSTRACT

A patient isolator includes a base and a cover which is arranged to seal with the base. The cover is formed from a rigid material and has two access ports on an end face. The two access ports are angled in a width direction relative to a plane which extends parallel to the width direction of the patient isolator. The two access ports are angled relative to each other. A method of isolating a patient from an environment is also disclosed.

16 Claims, 11 Drawing Sheets

(51) Int. Cl.
*A61G 1/04* (2006.01)
*A61G 1/00* (2006.01)

(56) References Cited

U.S. PATENT DOCUMENTS

| | | | | |
|---|---|---|---|---|
| D138,411 | S | 8/1944 | Armstrong | |
| D168,136 | S | 11/1952 | Armstrong et al. | |
| 2,699,826 | A | 1/1955 | Emerson | |
| D182,394 | S | 4/1958 | Adolphson | |
| D193,051 | S | 6/1962 | Jacobs | |
| 3,051,163 | A | 8/1962 | Trexler | |
| 3,051,164 | A | 8/1962 | Trexler | |
| D201,167 | S | 5/1965 | Gower, III | |
| D202,083 | S | 8/1965 | Berlin | |
| 3,272,199 | A | 9/1966 | Matthews | |
| 3,326,203 | A | 6/1967 | Goertzel | |
| 3,492,987 | A | 2/1970 | Parker | |
| 3,678,921 | A | 7/1972 | Brendgord et al. | |
| 3,848,278 | A * | 11/1974 | Propst | A47D 7/00 5/603 |
| 4,023,219 | A | 5/1977 | Shindler | |
| 4,026,286 | A | 5/1977 | Trexler | |
| 4,224,936 | A | 9/1980 | Cox | |
| 4,335,712 | A | 6/1982 | Trexler | |
| D266,700 | S | 10/1982 | Higgins | |
| 5,342,121 | A | 8/1994 | Koria | |
| 5,626,151 | A | 5/1997 | Linden | |
| 5,728,041 | A | 3/1998 | Fowler, Jr. | |
| 6,321,764 | B1 | 11/2001 | Gauger | |
| 6,367,476 | B1 * | 4/2002 | Conn | A61G 10/04 128/205.26 |
| 6,418,932 | B2 | 7/2002 | Paschal, Jr. et al. | |
| 6,461,290 | B1 | 10/2002 | Reichman | |
| 6,497,231 | B1 | 12/2002 | White | |
| D482,423 | S | 11/2003 | Newsome | |
| 6,669,626 | B1 * | 12/2003 | McDonough | A61G 11/00 600/22 |
| D491,669 | S | 6/2004 | Daffer | |
| D497,429 | S | 10/2004 | Tetrault | |
| D522,659 | S | 6/2006 | Cote | |
| D534,278 | S | 12/2006 | Lu | |
| D541,423 | S | 4/2007 | Gay | |
| D548,351 | S | 8/2007 | Weng | |
| D567,948 | S | 4/2008 | Tierney | |
| 7,503,890 | B2 | 3/2009 | Kubicsko | |
| 7,757,689 | B2 | 7/2010 | Chang | |
| 8,007,351 | B1 | 8/2011 | Maloney | |
| D651,714 | S | 1/2012 | Dougherty | |
| D710,503 | S | 8/2014 | Hudson | |
| D722,381 | S | 2/2015 | Mareguddi | |
| 9,186,232 | B1 | 11/2015 | Otto | |
| 10,016,252 | B1 | 7/2018 | Wren, Sr. | |
| D829,884 | S | 10/2018 | Eker et al. | |
| D845,180 | S | 4/2019 | Lait | |
| D851,194 | S | 6/2019 | Kidson et al. | |
| 2002/0112754 | A1 | 8/2002 | Gauger et al. | |
| 2003/0088911 | A1 | 5/2003 | Gedouin | |
| 2004/0177447 | A1 | 9/2004 | Love | |
| 2005/0004423 | A1 | 1/2005 | Shenosky et al. | |
| 2005/0150505 | A1 | 7/2005 | Burrow et al. | |
| 2006/0020159 | A1 | 1/2006 | Ellen | |
| 2007/0056593 | A1 | 3/2007 | Kubicsko et al. | |
| 2007/0088241 | A1 | 4/2007 | Brustad et al. | |
| 2011/0048424 | A1 | 3/2011 | Radko | |
| 2011/0290257 | A1 | 12/2011 | Hillis et al. | |
| 2015/0196423 | A1 * | 7/2015 | Nadau | A61G 11/006 600/22 |
| 2016/0309916 | A1 * | 10/2016 | Pothen | A61G 11/006 |

FOREIGN PATENT DOCUMENTS

| | | | |
|---|---|---|---|
| EP | 1 523 973 | A2 | 4/2005 |
| GB | 1022831 | A | 3/1966 |
| GB | 1 425 253 | A | 2/1976 |
| GB | 2 424 060 | A | 9/2006 |
| JP | 2010-065726 | A | 3/2010 |
| WO | WO 98/35614 | A1 | 8/1998 |
| WO | WO 00/38612 | A2 | 7/2000 |
| WO | WO 2006/085936 | A2 | 8/2006 |

OTHER PUBLICATIONS

International Search Report and Written Opinion of International Application No. PCT/EP2016/077598 dated Mar. 20, 2017, 19 pages.
Search Report of GB 1520065.2 dated May 10, 2016, 5 pages.
Search Report of GB 1520065.2 dated Dec. 8, 2016, 2 pages.
Search Report of GB 1520065.2 dated Dec. 13, 2016, 2 pages.

* cited by examiner

PATIENT ISOLATOR

The invention relates to a patient isolator and attachment equipment for a patient isolator such as a line entry apparatus and a ventilator port. Such patient isolators may be used to isolate patients from the external environment, either to protect the outside environment from the patient or vice versa.

In recent years there has been an increasing epidemic pressure and focus on highly infectious diseases (HID), actualized with the 2014/2015 Ebola epidemic in Western Africa. In addition the world is facing an increasing resistance to antibiotics, resulting in serious infections from microbes that earlier were easy to treat. This has resulted in an increased focus on HID and a greater need for protection against the spread of such diseases.

Patient isolators can also be used to protect patients from the external environment, such as immunocompromised patients.

Patient isolators are known for carrying patients who need to be isolated from the outside environment. A typical patient isolator comprises a frame which supports a flexible cover. The flexible cover is used to seal the patient from the external environment.

It is a challenge with patient isolators to make it possible to provide adequate or even optimal medical treatment for patients during transport, combined with adequate sealing of the patient from the environment.

In its broadest aspect, the present invention provides a patient isolator which comprises a base and a cover. One or more or any combination of the below described features may be used with a patient isolator which comprises a base and a cover (i.e. the broadest aspect of the invention).

The patient isolator may enable a person, e.g. health care personnel, to provide lifesaving procedures, for examples intubation of patient, whilst still isolating the patient from the external environment.

The present invention provides a patient isolator, the patient isolator comprising: a base; and a cover which is arranged to seal with the base, wherein the cover is formed of a rigid material.

In a first aspect, the present invention provides a patient isolator, the patient isolator comprising: a base; and a cover which is arranged to seal with the base, wherein the cover is formed from a rigid material, wherein the cover has two access ports on an end face, wherein the two access ports are each angled in a width direction relative to a plane which extends parallel to the width and height direction of the patient isolator, and wherein the two access ports are angled relative to each other.

By forming the cover from a rigid material is possible to provide a patient isolator with a reliable seal. It is also possible for the cover to have a fixed shape which means that it can be specially designed to make it possible to provide adequate medical treatment for patients during transport. For example, it is possible to precisely design the location of access ports/holes and to shape the cover to allow good visibility into the patient isolator.

The cover may not comprise, or be supported, by a frame. Instead the cover being rigid means that it may be possible for the cover to hold its own shape. The cover may not be formed of a fabric or flexible material.

Further, the fact that the cover is formed from a rigid material means that it can be easily cleaned, decontaminated and/or sterilised so that the patient isolator can be a multiple use unit even when it has been used to accommodate a highly infectious patient. If the cover is formed of a flexible material, such as a canvas, it is significantly harder to clean after use. Thus flexible patient isolators for highly infectious patients are only single use. Thus the herein described patient isolator may be suitable for multiple subsequent uses with a number of patients.

The patient isolator may be sized to accommodate an adult human. The patient transport isolator may be sized to only carry a single adult human, i.e. it may be an individual patient isolator. The patient isolator may be designed for a single patient to be located inside the isolator whilst medical personnel treating the patient are located outside the isolator.

The length of the patient isolator may be about 2000 to 2500 mm such as about 2250 mm. The width of the isolator may be about 500 to 750 mm, such as about 625 mm and the height of the isolator may be about 500 to 750 mm, such as about 625 mm. For example, the isolator may have a length, width and height which are 2290×645×655 mm respectively.

The patient isolator may be sized to accommodate a patient when lying down, e.g. when the patient is lying on their back. The patient isolator may be sized so that the patient cannot stand up. Thus, the patient isolator may be of a size which is convenient for transport and allows the patient to be transported in a horizontal, or approximately horizontal position.

The patient isolator may be arranged so that when in use it provides a seal to isolate the patient from the external environment. The seal may be a hermetic seal in respect of unfiltered air. The patient isolator may be sealed such that the only flow of air between the inside and outside of the isolator is filtered air. Air flowing between the inside and outside of the isolator may be filtered using a filter such as a P3 or a High Efficiency Particle Arrestance (HEPA) Air Filter.

The patient isolator may have two sides which extend along either side of a patient (when the patient isolator is housing a patient) and two ends; a head end (i.e. an end that in use will be near the head of the patient) and a foot end (i.e. an end that in use will be near the feet of the patient).

The cover may have an end face which is curved. The end face may have a curved portion in both a horizontal direction and a vertical direction. The end face may be curved in both a horizontal direction and a vertical direction. The curved end face may be at the head end of the cover.

Two access ports may be provided on the curved end face.

The curved end face can allow good visibility into the patient isolator whilst care is being provided to the patient in the patient isolator. The curved end face may also optimise access for medical procedures such as intubation.

The cover may form a dome shape. For example the cover may have a dome shape over the head of the patient. This allows a person outside of the patient isolator to have a good view of the patient in the patient isolator and also can allow sufficient volume for the patient to raise their head or sit up slightly in the patient isolator. This can allow the comfort of the patient to be increased.

The curved shape of the patient isolator may allow it to feel more spacious which can reduce problems with panic and/or claustrophobia for the patient housed in the patient isolator.

The cover may have a curved upper surface, e.g. the cover may be curved in a width direction on the upper surface. This curved upper surface may extend along the length of the cover, i.e. from the foot end to the head end of the cover.

The cover for example may be curved in a width direction over the top of the cover (i.e. curved across its width on the top surface), curved in a width direction across the head end face of the cover and curved in a vertical to lengthwise direction from the head end face to the top of the cover.

The curve in a vertical to lengthwise direction from the head end face to the top of the cover means that the cover does not have an angled surface near or above the head of the patient which could affect visibility into and out of the patient isolator.

The cover may have two access ports on an end face (such as the head end) of the cover and the two access ports may be angled relative to each other. Thus, the two access ports may be located to allow good access to the head and neck of the patient. Moreover, this access may be comfortable for the person accessing the patient in the patient isolator and allows a good view of the patient in the patient isolator.

The two access ports may be angled relative to each other in a width direction relative to a plane which extends parallel to the width and height direction of the patient isolator.

The access ports on the end face may be positioned in order to allow the healthcare personnel good access to the patient. For example, the access ports may be arranged to provide good access to the patient head, so as to be able to, for example, perform oropharyngeal intubation of the patient.

Whilst the (e.g. curved) end face may have some flat portions, such as flat portions on which access ports are located, the end face between the flat portions may be curved. If the end face comprises two or more access ports, the surface between and/or above and below the location of the access ports may be curved.

The access ports may be referred to as access holes or glove ports for example.

One, both, or all of the access ports on the end face may be angled in a width direction relative to a plane which extends parallel to the width and height direction of the patient isolator. For example, one, or more of the access ports may be angled (in the width direction) at between 10 and 60 degrees, 20 and 55 degrees or 30 and 50 degrees, e.g. about 40 degrees relative to a plane which extends parallel to the width direction of the patient isolator.

In the case of two access ports, the access ports may each be angled at the same angle (in a width direction) relative to a plane which extends parallel to the width and height direction of the patient isolator but in opposite directions, e.g. one port may be angled at about +40 degrees and the other port may be angled at about −40 degrees to a plane which extends parallel to the width and height direction of the patient isolator. The two access ports may be angled at between 80 to 120 degrees, e.g. about 100 degrees, relative to each other (this angle being the angle between the two access ports in a width direction). These two access ports may be between 5 and 10 cm apart, e.g. about 8 cm apart. This distance may be the distance between the ports, e.g. the distance between the two closest portions of the ports (for example the outer boundary of the port closest to the other port).

One or more of the access ports on the end face may be angled from the vertical. For example, the access ports may each be angled in vertical direction at between about 85 to 60 degrees, 70 to 75 degrees or about 73 degrees to the plane parallel with the horizontal bottom surface of the isolator.

The ports may be angled to complement/follow the curved/domed surface of the head end of the patient isolator.

The patient isolator, such as the cover, may comprise a plurality of access ports.

A pair of access ports may be located to provide access to the feet of the patient. This pair of access ports may be provided on the sides of the patient isolator towards the foot end of the patient isolator. One access port may be located on one side of the patient isolator and the other access port of the pair may be located on the other side of the patient isolator.

A pair of access ports may be located to provide access to the chest and/or shoulders of the patient. This pair of access ports may be provided on the sides of the patient isolator towards the head end of the patient isolator. One access port may be located on one side of the patient isolator and the other access port of the pair may be located on the other side of the patient isolator.

A pair (or two pairs of) access ports may be located to provide access to the abdomen, upper legs and knees of the patient. This pair (or two pairs) of access ports may be provided on the sides of the patient isolator about the centre of the patient isolator. One access port (or one of each pair) may be located on one side of the patient isolator and the other access port of the pair may be located on the other side of the patient isolator.

The patient isolator (such as in the cover) may therefore comprise five pairs of access ports. The patient isolator may have exactly 10 access ports in the cover.

The patient isolator may have a pair of access ports (one port on each side of the patient isolator) on the sides towards the foot end of the patient isolator, two pairs of access ports (one port of each pair being on each side of the patient isolator) on the sides about the centre of the patient isolator, a pair of access ports (one port on each side of the patient isolator) on the sides towards the head end of the patient isolator and a pair of access ports on the end face of the patient isolator. The two pairs of access ports about the centre of the patient isolator may be closer to each other than any of the other access ports of the patient isolator.

The access ports of the patient isolator may be provided in the cover.

The cover may comprise access ports on the sides of the cover and on an end face (such as the head end face) of the cover.

This means that a person outside the patient isolator can easily access the patient in the patient isolator.

The access ports may each have a diameter of about 8 inches (about 20 cm). This may be larger than the access ports on known patient isolators.

Each access port may be sealed (e.g. hermetically sealed) so as to provide an air tight cover. For example, the access port may be sealed with access equipment, such as a glove, to allow an external user to contact the patient. The access port may be sealed with other access equipment or attachment mechanisms such as a ventilator port, a waste bag port or an air-lock (i.e. sluice bag) bag. The air-lock bag may be used to allow equipment and/or medicines, etc, to enter the patient isolator without compromising the seal between the internal and external environment. The air lock bag may have an internal and external seal. The item that it is desired to move into the patient isolator may be put into the sir-lock bag through the external seal whilst the internal seal is shut, then the external seal may be shut before the internal seal is opened to allow the item to be moved into the patient isolator.

The base may also comprise ports, such as two or more equipment ports. These ports may be designed to accommodate attachment mechanisms such as a ventilator port and/or a line entry apparatus. Each of the ports on the base may be identical. This is so that the attachment mechanisms can be designed so that it can be used with any of the ports on the base. The ports on the base may be located at a head end of the patient isolator.

When the isolator comprises ports in both the cover and the base, the ports in the cover may be larger than the ports in the base. For example, the ports in the cover may be about 20 cm in diameter and the ports in the base may be about 15 cm in diameter.

The ports in the cover may be for access to the patient (and may each be sealed by a glove), whereas the ports in the base may be for attaching equipment and passing equipment such as lines or a ventilator hose into the isolator.

The seals on the access ports may be replaceable. This is so that, for example, after use, the seals, such as gloves, can be removed, the cover decontaminated and then new seals fitted.

Each port may comprise two locking rings. The locking rings may sandwich the edge of the cover or base (depending on the location of the port) and seal thereto. The two locking rings may be referred to as a sandwich ring.

One locking may be an internal locking ring that in use is located on the inside of the patient isolator and one locking ring may be an external locking ring that in use is located on the outside of the patient isolator. The pair of locking rings may be screwed together through the cover or base of the patient isolator and may seal to each other and the patient isolator. One or more seals, such as an O-ring, may be located between each locking ring and the patient isolator.

Each port may comprise a locking ring locking mechanism, i.e. there may be a locking mechanism securing the two sandwich rings to each other. The locking ring locking mechanism may be arranged to prevent inadvertent unaffixing of the locking rings from the patient isolator. For example, the locking mechanism may be arranged so that one has to push down a lip on one of the locking rings to allow the rings to be removed, such as unscrewed, from the patient isolator.

Each port may comprise two caps. One cap may be an internal cap that in use is located on the inside of the patient isolator and one cap may be an external cap that in use is located on the outside of the patient isolator.

The presence of an internal cap may allow equipment attached to a port to be changed, removed, or added whilst keeping the internal environment isolated from the external environment.

Each cap (whether an internal cap or external cap) may sealingly engage with the patient isolator, e.g. a port, to provide a hermetic closure of the port. The caps may each be arranged so that they are fixed to the patient isolator by being screwed onto an inner or outer surface of a port.

The internal cap may be arranged so that it can be unattached, e.g. unscrewed, from the inside and/or the outside of the patient isolator and/or the external cap may be arranged so that it can be unattached, e.g. unscrewed, from the outside and/or the inside of the patient isolator.

The internal and external caps may have a handgrip on both sides, so the caps can be opened from either side.

The internal and/or external cap might be transparent. This is so that it may be possible to see (at least partially) through the port even if one or both of the caps are in place.

The port may comprise a third ring, which may be referred to as an affixing ring, for affixing and sealing equipment (such as a glove, waste bag, air-lock bag, ventilator port, line entry apparatus) to the port. The affixing ring may affix, such as screw onto one of the, such as the external, locking ring. Equipment, such as a glove, waste port, air-lock bag etc, may be sealed onto the affixing ring and then affixed and sealed onto the patient isolator by means of the affixing ring being affixed (such as screwed) and sealed onto one of the locking rings.

The equipment may be mounted around a lip/flange of the affixing ring, in a circumferential socket/recess. When the affixing ring is affixed, such as screwed, into the "sandwich"-ring, the equipment is secured to the patient isolator. The equipment may also act as a gasket between the affixing ring and one of the locking rings.

Each affixing ring may comprise an affixing ring locking mechanism. This may be used to avoid unwanted opening of the affixing ring that holds the equipment. For example, the affixing ring may comprise one or more clips (such as three) that have to be pushed down to allow the affixing ring to be removed, e.g. unscrewed, from the patient isolator.

The cover may be transparent. This also allows the patient to be viewed when in the patient isolator. The transparent material may allow for optimal visibility for the patient which can help prevent claustrophobia and/or can allow the caregiver to observe and communicate with the patient.

The cover may be completely (i.e. entirely) transparent. This may mean that all of the material which makes the cover is transparent, apart from features on the cover such as access ports and clips for securing the cover.

The cover may be formed from a transparent material such as polycarbonate. The cover may be a single piece, e.g. the cover may be formed (e.g. moulded) as a single component. Apart from any access ports which may be present, the cover may be a continuous component. This minimises the risk of patient isolator not effectively isolating the internal environment from the external environment.

The base may be formed from a rigid material. The base may be formed from a lightweight material. The base may be formed from aluminium, carbon fibre, plastic, a thermoplastic, a polycarbonate or a polycarbonate blend for example.

The materials from which the cover and/or base are formed may be non-flammable.

For example, the materials from which the cover and/or base are formed may be made of fire resistant material, for instance classified according to the UL94 system, grade V0.

The base may have a bottom portion, this bottom portion may be substantially flat. The base may have sides which extend from the bottom portion. When the bottom portion is supported on a surface (as in in use) the sides may extend substantially upwardly from the base portion on all sides so as to form a tray. In other words, the base may have a rim which extends around the entire periphery.

The base may provide a watertight container for collecting liquids. The base may be watertight (i.e. between the bottom portion and the sides) so that no liquids collected in the base can leak from the base.

The bottom portion and the sides of the base may be integrally formed. For example, the base may be a single formed (e.g. moulded) piece.

The foot end of the base may have a side which extends upwardly to provide the majority of the foot end face of the patient isolator.

This foot end face (which may be provided by the base) may provide a surface for attaching and carrying components which need to be connected to the patient isolator. For example, components such as a battery, fan and/or filter may be provided on the foot end face of the patient isolator. Thus the base may comprise fittings for components to be used with the patient isolator.

The patient isolator may be designed so that all external components and fittings (aside from those connected to ports) are attached to the base of the patient isolator. This is because the base can be designed to be strong enough for these components so that the risk of compromising the seal can be avoided.

This is a convenient location for these components to be supported (without providing too much of an obstruction to the treatment of the patient in the patient isolator).

The base may comprise a sealing surface to which the cover can seal. For example, the base may comprise a lip to which the cover can seal. The lip may extend around the entire periphery of the base. The lip may comprise a groove in which a gasket, such as an O-ring, can seal. When the cover is attached to the base the gasket may seal on one side to the base and on the other side to the cover. The gasket may be provided on either the cover or the base to seal with the other component when the cover and base are brought into engagement.

The cover may be arranged to engage with the base to form a seal. For example, the cover may be sized to engage with the lip on the base and in this case there may be a gasket (e.g. a rubber seal) between the cover and the base.

The seal between the base and the cover may be a hermetic seal.

When the cover and the base are sealed together the interior of the patient isolator may be isolated from the external environment. This may mean that there is no unfiltered air flow between the internal and external environment of the patient isolator. Thus, the patient in the patient isolator may be protected from the external environment and/or the external environment may be protected from the patient. In other words the patient isolator may be for protecting the environment against contamination from the patient and/or for protecting the patient against contamination from the environment.

The patient isolator may have an attachment mechanism, e.g. a fastener, for attaching the cover to the base. The patient isolator may for example be provided with one or more clips which are for clipping the cover and base together. For example the patient isolator may comprise 6 or more clips which are spaced around the periphery of the patient isolator to allow a secure connection between the cover and the base over the whole connection surface between the two components.

The clips may be affixed to the base of the patient isolator.

The clips may each have a rounded clip top which clips onto the cover, e.g. a curved lower part of the rigid cover.

Each clip may be secured in the locked position by a button. This button may have to be pushed down to enable the opening of the clip. This may be used to avoid inadvertent or accidental opening of the clips.

Each clip may be arranged so that it can be dismounted entirely from the patient isolator, e.g. from the base part, in order to allow it to be cleaned and disinfected.

The patient isolator may not comprise a zipper which could allow contamination between the internal and external environments of the patient isolator.

Thus the patient isolator may be simple and easy to use and so help prevent user errors which could lead to contamination.

When the patient isolator is for isolating the external environment from the patient the internal environment of the patient isolator may be controlled to have a pressure which is less than atmospheric pressure (i.e. a negative pressure). This is to ensure that if there is a break in the seal isolating the patient, air will move from the external environment into the patient isolator so that protection for the external environment from the patient can be, at least partly, maintained. When the patient isolator is for isolating the patient from the environment the internal environment of the patient isolator may be controlled to have a pressure greater than atmospheric pressure (i.e. a positive pressure). This is to ensure that if there is a break in the seal isolating the patient, air will move from the patient isolator to the external environment so that protection for the internal environment can be, at least partly, maintained. The pressure in the patient isolator may be maintained and/or controlled by means of a fan. The flow of air caused by the fan may be filtered.

The patient isolator may be designed to allow the transport of patients that need to be isolated from the external environment.

The patient isolator, e.g. the base, may have a stretcher attachment (e.g. standardized mounting adapters) which allows the patient isolator to be connected to a stretcher frame/undercarriage. This may allow the patient isolator to be connected to a stretcher frame/undercarriage so that it can be wheeled and/or put into a vehicle such as an ambulance for transportation.

The base may act as a stretcher and may have a generic attachment adaptor for all types of ambulance stretcher frames.

The patient isolator may comprise L-tracks (which may be referred to as airline tracks) on the underside of the base. The L-tracks may be mounted in parallel in the base of the device. The L-tracks may have a centre to centre (c-c) distance between them to allow the patient isolator to be fixed to an undercarriage. For example, the cc-distance may be 382.5 mm.

The L-tracks may constitute a weight-carrying part, and may be directly connected to a patient restraint system and an internal stretcher/bed. This may help ensure that forces from an impact are directed to the fixation of the device. The L-tracks may make it easy to fix the device to any structure via suitable adapters.

The patient isolator may comprise one or more carrier handles. The carrier handles may be curved structures. The carrier handles may be mounted between the L-tracks (if present). The carrier handles may fix the L-tracks together. The carrier handles may strengthen and stabilize the L-track frame.

The carrier handles may provide handles for carrying the device. The handles may be curved upwards in order to allow the carrier's hands around it when the device is on the ground. The carrier handles may extend out beyond the head end and the foot end of the patient isolator. As such the carrier handles may be arranged to help protect the equipment, such as filters, blower and other equipment in the head and foot end of the patient isolator. This is because the carrier handles may act as the first point of contact if the patient isolator hits in to another object or the ground.

The patient isolator may comprise a bed. The bed may be for the patient to lie on. The bed for example may be a specially designed stretcher mattress. Thus, the patient isolator may have an internal, adjustable stretcher mattress.

The bed may be adjustable so that the patient can be held in a position other than completely horizontal. This can help increase the comfort of the patient in the patient isolator, particularly when they are housed in the patient isolator for a long time, such as on a long journey.

The bed may have an adjustable leg portion and/or an adjustable back portion. When the bed has both an adjustable leg portion and an adjustable back portion these two portions may be independently adjustable. This may allow the comfort of the patient to be increased.

The position of the bed may be controllable from outside the patient isolator. For example, this may be possible by controlling the position of the bed through the access ports. This will allow people outside the patient isolator to adjust the position of the patient.

The bed may comprise one or more actuators, such as mechanical- or gas springs, which allow the position of the bed to be adjusted.

The bed may be attached to the base. This may be a releasable attachment. For example, the bed may have a connection portion which is received in a groove in the base. This allows the bed to be easily disconnected from the base and also minimises the number of parts of patient isolator.

The patient isolator may comprise a protection coating. For example, the cover and/or base may be coated with a paint, or other coating (such as a hard scratch resistant coating) to protect the cover or base from damage such as scratches which could allow contaminants to become trapped on the surface. The protection coating may also make the base and/or cover easier to clean.

The patient isolator may comprise a protection cover. This protection cover may cover at least the external surfaces of the cover and/or base. Such a protection cover may be attached to the patient isolator before the patient is put into the patient isolator. This cover may prevent contamination on the outside (i.e. external surface) of the patient isolator before and/or whilst the patient is put into the patient isolator and the patient isolator is in an infected environment. Once the infected patient is in the patient isolator and the patient isolator is removed from the infected environment, the protection cover may be removed from the patient isolator. This means that the outside of the patient isolator will not be contaminated and thus people working outside the patient isolator, such as in treating the patient, may be safe to work without having to wear protection suits or equivalent.

The protection cover may be disposed of once used and removed from the patient isolator.

In certain circumstances, it can be particularly important to protect the base of the patient isolator. This is because the base may be more likely to come into contact with an infected surface (where the patient may have been before they were put into the patient isolator). Thus it is convenient to be able to protect, at least the external surface of the base, with a protective cover which can be removed once out of an infected environment.

The patient isolator may comprise a second cover. The second cover may be larger than the first cover. This second cover may be designed to be able to form a seal with the base. The second cover may be interchangeable with the first cover.

The second cover may enable the patient to stand up and move when in the patient isolator. This second cover may be referred to as a tent attachment. This may be useful during long-term transportation and/or if is desirable for a medical worker (wearing infection protection equipment) to also be in the patient isolator so they can thoroughly examine and treat the patient.

The second cover may be made of a soft and/or flexible material. This will allow the second cover to be transported more easily.

The patient isolator may also be referred to for example as any one of an isolation stretcher, a portable isolation bed, a patient isolation unit, personal isolation unit, a portable medical isolation unit (PMIU), a portable transportation chamber for infected people, portable emergency medical isolation and transport unit, portable negative pressure transportation chamber, a patient transportation unit, a patient transport isolator or a transport isolator. The term to which the isolator is referred may depend on the exact features of the isolator and its intended use, e.g. whether it is suitable for transportation. When especially adapted for transport the isolator may be referred to as a patient transport isolator.

In a second aspect, the present invention provides a patient isolator, the patient isolator comprising: a base; and a cover, wherein the cover has a curved end face.

In a third aspect, the present invention provides a patient isolator, the patient isolator comprising a base; and a cover, wherein the cover has two access ports on an end face of the cover and wherein the two access ports are angled relative to each other.

In its broadest aspect, the present invention provides a patient isolator which comprises a base and a cover.

The patient isolator of these further aspects may have one or more of the features, including the optional features, discussed above in connection with the first aspect of the invention.

The present invention may also provide a method of isolating a patient from an environment, the method comprising placing a patient in a patient isolator, the patient isolator comprising: a base; and a cover, wherein the cover is formed from a rigid material, and/or the cover has a curved end face, and/or wherein the cover has two access ports on an end face of the cover and wherein the two access ports are angled relative to each other, and sealing the patient isolator to isolate the patient from the environment.

The patient isolator may also have one or more of the features, including the optional features, described above.

The above described patient isolator may comprise a line entry apparatus for providing a seal around one or more lines entering a patient isolator. The line entry apparatus may be as described below.

In a fourth aspect, the present invention provides a line entry apparatus for providing a seal around a line entering a patient isolator, the line entry apparatus comprising: a support; and a seal; wherein the support comprises an aperture for a line to extend through, and wherein the seal is arranged so that, in use, when a line extends through the aperture, the seal will seal around the line.

This line entry apparatus may provide a convenient and reliable way of sealing around one or more lines which are entering the patient isolator.

The lines may for example be IV lines for administering fluids or drugs to the patient, oxygen lines, monitoring cables/wires for equipment used to monitor the patient and/or electrical cables/wires for any other equipment that may be located within the patient isolator with the patient.

The line entry apparatus may also be referred to as a line seal, wire port, line entry port, multiport, a box seal or a junction box for example.

The support may be formed of a rigid material. For example, the support may be formed of carbon fibre, aluminium, or plastic, such as a thermoplastic such as a polycarbonate or a polycarbonate blend.

The support may be designed to sealingly engage with the patient isolator. For example, the support may form a seal with a portion of the patient isolator. The patient isolator may have a port, hole or recess to receive the support portion of the line entry apparatus.

The line entry apparatus may be attached to a locking ring (which is attached to a port so as to attach the line entry apparatus sealingly to a patient isolator), if present. This may be via an affixing ring (which attaches to a sandwich ring of two locking rings) or the line entry apparatus may affix, e.g. screw, directly to one of the port locking rings.

The line entry apparatus may be arranged to receive the line and then be attached to the patient isolator. Alternatively, the line entry apparatus may be attached to the patient isolator and then the line may be passed through the aperture of the line entry apparatus.

The seal may be supported by the support of the line entry apparatus.

The seal may be formed of an elastic material. For example, the seal may be formed of silicone, rubber, latex, neoprene and/or thermoplastic elastomer (TPE).

The seal may comprise a soft sealing membrane. The membrane may be attached about the aperture, for example, to an inside surface (i.e. on the side the patient will be located in use) of the support. The membrane may have a hole through which a line can pass. The hole in the membrane may have a diameter that is smaller than the diameter of the line which in use will pass through the hole. Thus, in use, the line may pass through the membrane and the membrane can seal against the line.

The hole may be 0.5 to 3 mm in diameter. Although the ideal hole diameter may depend on the line to be passed through the line entry apparatus.

The seal, for example when it is a membrane, may be in a cone shape. For example, the seal may comprise a conical sealing surface. The cone shape may taper in a direction away from the support towards the inside of the patient isolator.

The support may be a plate (e.g. a lid or a disc) which can be attached to a port on the patient isolation unit. The plate may have a number of apertures there through. The number of apertures may correspond to the maximum number of lines that the line entry apparatus can accommodate.

The support may comprise a plurality of apertures (such as nine). The line entry apparatus may comprise a seal associated with each aperture. Alternatively, a seal may provide the sealing surface for two or more, or all, of the apertures in the support.

The support may comprise apertures of different sizes. For example, the support may comprise one or more apertures of one size and one or more apertures of another size. This can allow the line entry apparatus to be able to accommodate lines of different diameters whilst still being able to provide a reliable seal.

The line entry apparatus may comprise a plug. The plug may be arranged to engage with the seal so as to seal the aperture of the support when there is no line passing through the aperture.

The plug may be shaped to complement the shape of the seal. For example, when the seal is a membrane in a cone shape, the plug may have a cone shape. The plug may have a protuberance at one end. The protuberance may be shaped to pass through the seal and be located on an inside surface of the seal, whilst the rest of the plug is located on an outside surface of the seal. The diameter of the protuberance may be greater than the diameter of the hole in the seal. The diameter of the conical portion of the plug immediately next to the protuberance may be greater than the diameter of the hole in the seal. The protuberance may act to hold the plug against the seal. The conical portion can provide a surface against which the membrane can seal. This can ensure that the inside environment of the isolator is isolated even when a line does not pass through the seal.

When there are a plurality of apertures the line entry apparatus may comprise a plurality of plugs, e.g. there may be a plug for each aperture.

The plug may be located in the aperture in the support and engage with the seal. When it is desired to insert a line through the seal the plug may be removed so that the line can pass through the aperture. The plug may be removed by moving the plug through the seal into the patient isolation unit.

The line to be inserted through the aperture may be attached to the plug. Thus, when the plug is moved through the seal into the patient isolator it may pull the line through the seal. The seal may immediately seal around the line after the plug is forced through the seal.

Alternatively the seal may comprise a first (seal) portion, the first portion having a first elastic seal surface; and a second (seal) portion, the second portion having a second elastic seal surface. The seal may be arranged so that, in use, the first elastic seal surface is put in contact with the second elastic seal surface so as to form a seal between the first portion and the second portion and any lines that extend through the seal across the first elastic seal surface and the second elastic seal surface.

The seal portions (i.e. the first and second portions) may be movable relative to each other between an open position and a closed position. When the line entry apparatus is in the open position it may be possible to position one or more lines across one of the elastic seal surfaces.

When the line entry apparatus is in the closed position, the elastic seal surfaces may be in contact with each other so as to form an airtight seal between the two elastic seal surfaces and any lines which are between the two elastic seal surfaces so as to form the seal.

The seal portions may be connected to each other, such as via a hinge or pivot. This means that the seal surfaces can be appropriately positioned relative to each other when the seal is closed.

The line entry apparatus may have a variable height in a width direction. For example, the line entry apparatus may have a height that increases across the line entry apparatus in a direction from the internal environment of the patient isolator to the external environment of the patient isolator in use.

For example, the line entry apparatus may be wedge shaped.

The patient isolator may have a receiving hole for the line entry apparatus. The receiving hole may have a corresponding shape, such as a wedge shape, to the line entry apparatus. The receiving hole may have a gasket, such as an O-ring, around its periphery. This is so that when the line entry apparatus is inserted into the receiving hole, a reliable seal can be formed between the line entry apparatus and the patient isolator.

As an example, in use, when the line entry apparatus is open, the lines (i.e. one or more lines) which are to extend into the patient isolator from an external environment may be laid across one of the elastic seal surfaces. The line entry apparatus may be closed by bringing the two elastic seal surfaces into contact so as to seal between the two elastic seal surfaces and the one or more lines. The line entry apparatus may then be inserted into the receiving hole so as to form a seal between the patient isolator and the line entry apparatus.

The width of the line entry apparatus may be the dimension in the direction that the lines lie in use, i.e. in a direction which is from the external environment to the internal environment (or vice versa) in use. The length may be the dimension in the plane of the sealing surface which is perpendicular to the width. The height may be the dimension which is perpendicular to the width and length directions.

One or both of the elastic seal surfaces may be a silicone surface.

The seal portions may be supported/housed by the support.

The support may provide a rigid outer surface on all sides of each seal portion except the elastic seal surface. The rigid outer surface may form a rigid outer shell, i.e. the support may comprise a rigid outer shell.

Each seal portion may comprise an elastic part which is supported in the rigid shell. The elastic part may form the elastic seal surface. When the line entry apparatus is in the open position, each elastic part may protrude from its respective rigid shell. When the line entry apparatus is in the closed position, the rigid shell around each seal portion may be in contact so as to provide a rigid outer surface substantially over the entire outer surface of the line entry apparatus. The rigid outer surface formed when the two seal portions are in contact may be box shaped, i.e. the support may be box shaped. For example, the box may be a wedge. This is to allow a good seal with the patient isolator as described above.

The elastic part of each seal portion may be a compressible material. The line entry apparatus may be arranged so that when the line entry apparatus is in the closed position the elastic parts are urged against each other and are compressed. This may allow a reliable seal to be formed.

The elastic part may be a convex portion such as a pillow.

The elastic part may be formed of silicone and may be filled with a compressible material such as air or foam.

The rigid outer shell of the support may comprise one or more recesses on either side of the elastic seal surface. The recesses may be provided in pairs on opposing sides of each of the seal portions (i.e. one recess of the pair is provided on one side and the other recess of the pair is provided on the other side). These recesses may be designed to each receive a line which is positioned across the seal surface. The recesses may be provided in pairs so as to provide an entry and exit recess for each of the lines extending across the seal portion. When the line entry apparatus is in the closed position the recesses on each of the seal portions meet to form the aperture through which a line can extend. The rigid outer shell may comprise a plurality of pairs of recesses equal in number to the maximum number of lines that the line entry apparatus is designed to accommodate.

The line entry apparatus may comprise a fastener, such as a clip, catch, latch or bolt. The fastener may be used to maintain the line entry apparatus in the closed position so as to maintain the seal between the elastic seal surfaces and the lines.

When the line entry apparatus comprises a fastener, the lines may be placed across the seal surfaces, the line entry apparatus may be closed to urge the two elastic seal surfaces together and then locked/held in place using the fastener. The line entry apparatus may then be inserted into the receiving hole in the patient isolator.

The line entry apparatus may provide a convenient, reliable and safe means for many lines to enter into the patient isolator.

The above described patient isolator may comprise a ventilator port for a ventilator entering the patient isolator. The ventilator port may affix, such as screw, onto one of the locking rings. This may be directly or via an affixing ring. The ventilator port may have one or more of the below described features.

In a fifth aspect, the present invention provides a ventilator port for a patient isolator, the ventilator port comprising: a sealing surface against which a part of a ventilator can seal, wherein the sealing surface is movable between an extended position and a retracted position.

The part of the ventilator may be a ventilator filter. Thus, the sealing surface may be a surface against which part of the ventilator filter can seal.

By being able to move the sealing surface of the ventilator port into the patient isolator the port may be able to accommodate ventilators with different length hoses and endotracheal tubes (ET). The ability to move the sealing surface may mean the ventilator can be moved all the way to the oropharyngeal tube in front of the patient's mouth whilst still providing a seal between the internal and external environment. It also means that the filter can be located on the external side of the ventilator port which means that more types of ventilators can be used with the patient isolator. This is because the ventilator hose may be specific to the specific brand of ventilator being used. Thus, if the filter is outside (i.e. in contact with the external environment) the isolator it can be changed if necessary.

The ventilator port may provide a more flexible attachment means for a ventilator.

The ventilator port may provide a seal around a portion of a ventilator (such as a ventilator hose and/or ventilator filter) which is extending into the patient isolator. The seal may be an airtight seal so as to maintain the isolation between the interior of the patient isolator and the external environment at the point where the ventilator enters the patient isolator.

The extended position may be when the sealing surface is located into the interior of the patient isolator and the retracted position may be when the sealing surface is located substantially in line with the cover and/or base of the patient isolator.

The sealing surface may comprise an aperture through which a portion of the ventilator (such as a ventilator filter or ET tube) can extend into the patient isolator. The aperture may have an elastic ring which can seal onto the portion of the ventilator (such as a ventilator filter) that extends through the aperture. The aperture may have a diameter which is smaller than the component of the ventilator which extends through the aperture. This is so that a reliable seal can be formed between the sealing surface and the portion of the ventilator which extends through the sealing surface.

Thus, when the sealing surface is moved between the extended position and the retracted position the seal between the inside of the patient isolator and the external environment may be maintained.

The ventilator port may be designed to be received in a port of the patient isolator, such as a port on the base of the patient isolator.

The ventilator port may comprise a conduit (e.g. flexible sleeve/tunnel) which at one end is fixed to the patient isolator and at the other end to the sealing surface.

The conduit may be designed to allow the sealing surface to be movable between an extended position and a retracted position. For example, the conduit may be formed of a material which can be folded up when the sealing surface is in the retracted position and unfolded when the sealing surface is in the extended position. The conduit may be formed of a flexible material.

The sealing surface may comprise a seal annulus which extends around the aperture on the sealing surface through which the ventilator extends. The seal annulus may be provided on the surface of the sealing surface which faces the external environment.

The seal annulus may be formed so as to seal against a portion of the ventilator (such as the ventilator filter). This seal annulus can provide a secondary seal to the elastic aperture so as to provide a more reliable seal.

The seal annulus may be formed of an elastic and/or compressible material so as to be able to form a seal with a portion of the ventilator.

The seal annulus may be wedge shaped in cross section. In other words, the thickness of the annulus at the external diameter may be greater than the thickness of the annulus at the internal diameter of the seal annulus.

The seal annulus may have a surface that is angled from the outer diameter to the aperture. This may form frusto-conical sealing surface that extends in a direction towards the internal environment of the patient isolator. This may allow a better seal between the seal annulus and the portion of the ventilator, such as the filter, in contact with the seal annulus.

The seal annulus may have a shape that is complementary to the shape of the portion of the ventilator against which it is designed to seal.

The ventilator port may comprise a cap. This cap may be designed to attach to the patient isolator on the external face. This cap may protect the ventilator port before a patient is put into the patient isolator and a ventilator is connected to the patient isolator, e.g. such as during transportation of the patient isolator to the patient.

The cap may attach to an external portion of the access port. For example, the cap may screw onto the patient isolator, such as the (e.g. access or equipment) port. A seal, such as an O-ring, may be provided between the patient isolator and the cap.

The present invention may provide a system which comprises a patient isolator with a ventilator port as described above and a ventilator.

In use a portion of the ventilator (e.g. ventilator hose) may extend through the ventilator port into the patient isolator. The sealing surface may seal to a portion of the ventilator such as the ventilator filter.

The ventilator may comprise an endotracheal tube (ET tube), a filter and a ventilator hose. In use, the ET tube may be located inside the patient isolator and may connect to the filter, the main body of which is located on the external side of the sealing surface of the ventilator port. The filter may be connected to the ventilator hose.

The sealing surface may be designed to seal against the filter of the ventilator.

The filter may have a connection portion for connecting to the ET tube. The aperture in the sealing surface may extend around and seal to the ET tube connection portion of the filter.

The main body of the filter may be shaped to engage with the seal annulus (if present) of the ventilator port so as to provide a secondary seal. For example, the body of the filter may have an angled face which complements the shape of the seal annulus which may have a wedge shaped cross section.

The above described patient isolators may comprise the above described line entry apparatus and/or ventilator port. The line entry apparatus and/or ventilator port may comprise one or more of the above described preferable features.

The line entry apparatus and the ventilator port may be designed to attach to the same size port of a patient isolator. This means that line entry apparatus and the ventilator port can be used interchangeably with the ports of the patient isolator.

Certain preferred embodiments of the present invention will now be described by way of example only with reference to the accompanying drawings, in which.

Figure 1:
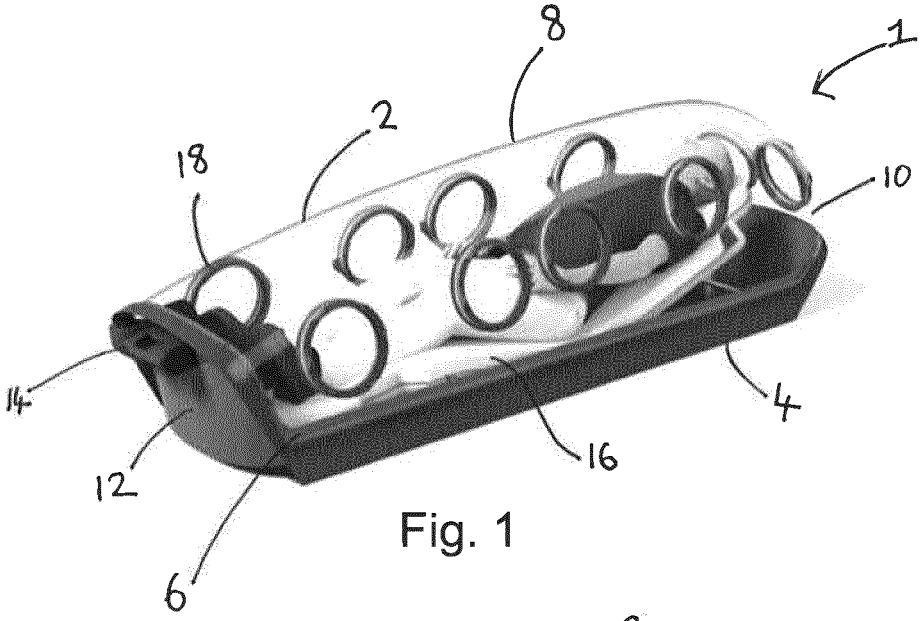
FIG. 1 is a perspective view of a first patient isolator.
Figure 2:
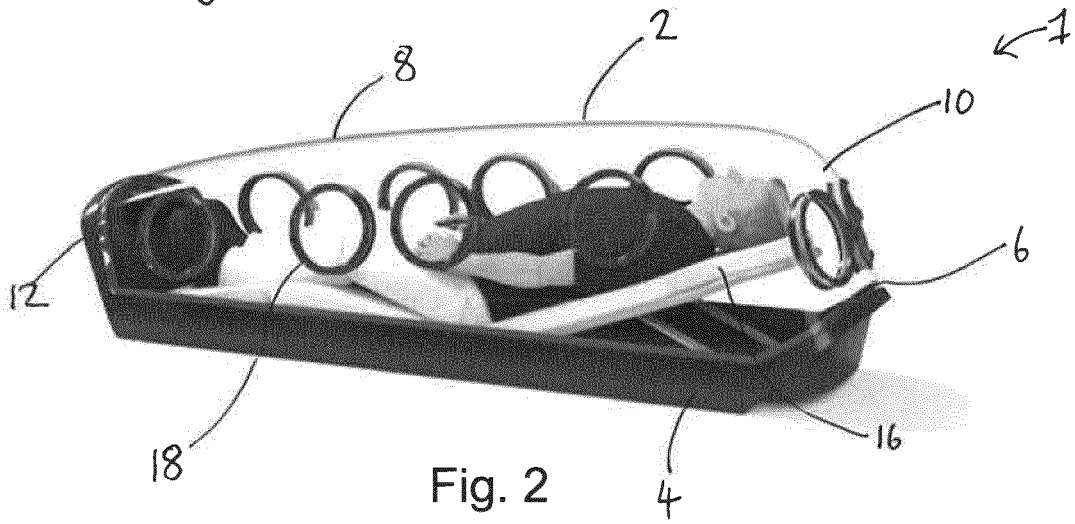
FIG. 2 is another perspective view of the first patient isolator of FIG. 1.

A patient in a patient isolator 1 is shown in FIGS. 1 and 2. As can be seen in these Figures, the patient isolator 1 comprises a rigid cover 2 (which may for example be formed of polycarbonate) and a rigid base 4 (which may for example be formed of carbon fibre, aluminium, or plastic, such as a thermoplastic, a polycarbonate or a polycarbonate blend). In use the cover 2 seals with the base 4 to isolate the patient from the outside environment. This may be to protect the environment from the patient or to protect the patient from the environment.

The base 4 has upwardly extending sides on all edges of the base 4 so as to form a tray shape. This allows the collection of any fluids from the patient in the base 4. This is watertight as the base 4 is formed as a single component.

The base 4 has a lip 6 around its entire periphery which receives the bottom edge of the cover 2. The lip 6 of the base 4 is sized so that the cover seals to the base 4. An O-ring may be provided between the lip 6 of the base 4 and cover 2 to provide a good seal between the cover 2 and the base 4.

Figure 27:
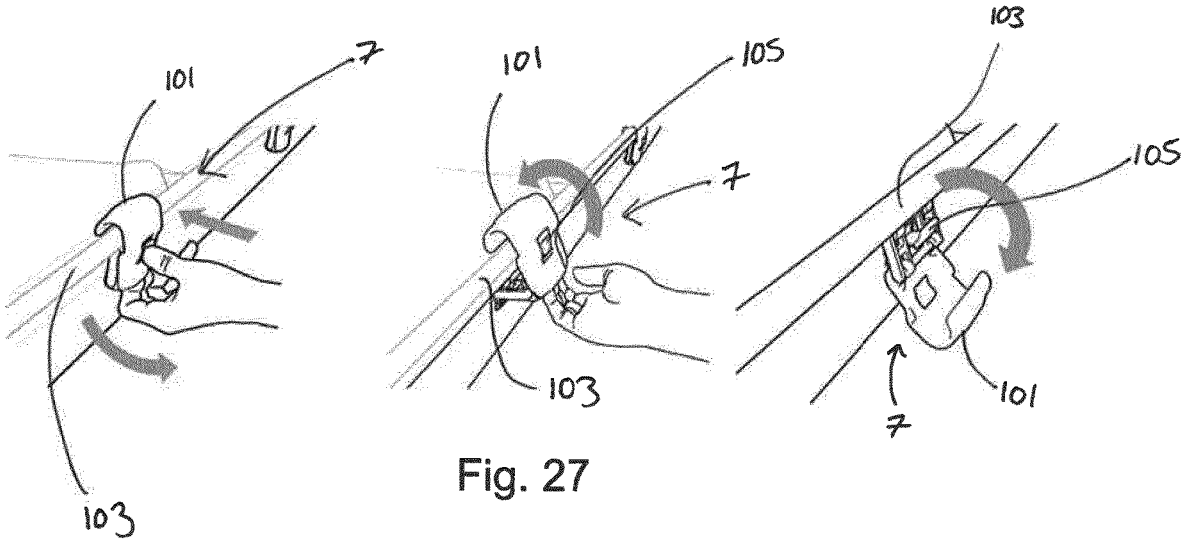
FIG. 27 shows details of an exemplary clip.

The patient isolator 1 may be provided with clips 7 (not shown in FIG. 1 or 2) which allow the cover 2 to be fastened to the base 4. Details of an exemplary clip 7 are shown in FIG. 27. These clips 7 are attached to the base 4 of the patient isolator 1.

The clips 7 each have a rounded clip top 101 which clips onto a curved lower part 103 of the rigid cover 2.

Each clip 7 is secured in the locked position by a button 105. This button 105 has to be pushed down (as shown in the left-hand illustration of FIG. 27) to enable the opening of the clip 7. This may be used to avoid inadvertent or accidental opening of the clips 7. Each clip 7 is arranged so that it can be dismounted entirely from the patient isolator 1 in order to allow it to be cleaned and disinfected.

As can be seen from FIGS. 1 to 10 for example, the cover 2 is dome shaped and is curved across its width on the top surface 8, curved across its width on the head end face 10 and curved from the head end face 10 to the top surface 8 in the lengthwise direction.

The foot end face 12 of the patient isolator 1 is provided by a part of the base 4. This foot end face 12 may provide attachment means 14 for supporting components such as a fan (which may be used to control the pressure in the patient isolator), a filter and/or monitoring equipment.

The base 4 may have a receiving hole for a line entry apparatus 20 for lines, such as IV lines, monitoring cables, or electrical wires, entering the patient isolator 1 (although not shown in FIG. 1 or 2). The receiving hole may have a gasket, such as an O-ring, around its periphery. This is so that when the line entry apparatus 20 is inserted into the receiving hole, a reliable seal can be formed between the line entry apparatus 20 and the patient isolator 1.

The patient isolator 1 may comprise a bed 16 on which a patient lies when in the patient isolator 1. The bed 16 has individually adjustable head and leg portions. This is so the patient can be put into a comfortable position when in the patient isolator 1.

The bed 16 may engage in grooves in the base 4.

The cover has a number of access holes 18. In the example patient isolator 1 shown in FIGS. 1 and 2, the patient isolator 1 has ten access holes 18.

Two access holes 18 are provided on the head end face 10. As the head end faced 10 is curved/domed the two access holes 18 on this face 10 are angled relative to each other and angled relative to the plane which is parallel to the width and height direction in both the width and height directions. This can make access to the patient easier and/or more comfortable for a person outside the patient isolator 1 who is treating the patient.

The patient isolator 1 (more specifically in the cover 2) also has a pair of access holes 18 near the foot end of the patient isolator 1, two pairs of access holes 18 near the centre of the patient isolator 1 and a pair of access holes 18 near the head end of the patient isolator 1.

The access holes 18 in use will be sealed (although not shown in FIG. 1 or 2) for example by gloves, a ventilator port and/or a lid as explained in greater detail below in relation to FIGS. 21 to 25.

Figure 3:
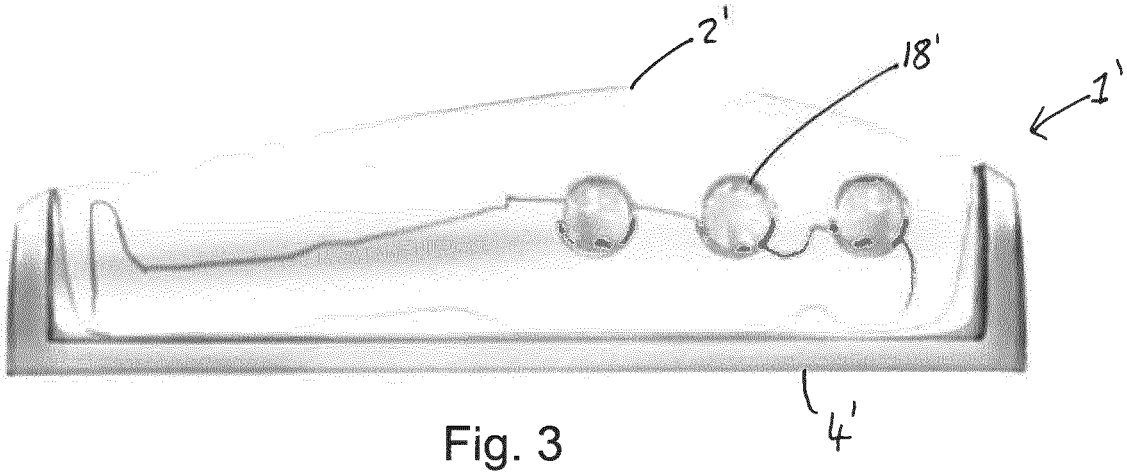
FIG. 3 is a side view of a second patient isolator.

FIG. 3 shows a second patient isolator 1' which comprises a curved rigid cover 2' and a base 4' to which the cover 2' seals. Similarly access ports 18' are provided in the cover 2'.

FIGS. 4 to 8 show a third patient isolator 1". Except where specified, the third patient isolator 1" has the same features as the first patient isolator 1 and the corresponding features of the third patient isolator are marked with the same number followed by ".

As can be seen from these figures the patient isolator may comprise ports 5" on the base. These ports 5" may comprise apertures for allowing connection mechanisms such as a line entry apparatus or a ventilator port to be connected to the patient isolator 1".

Figure 8:
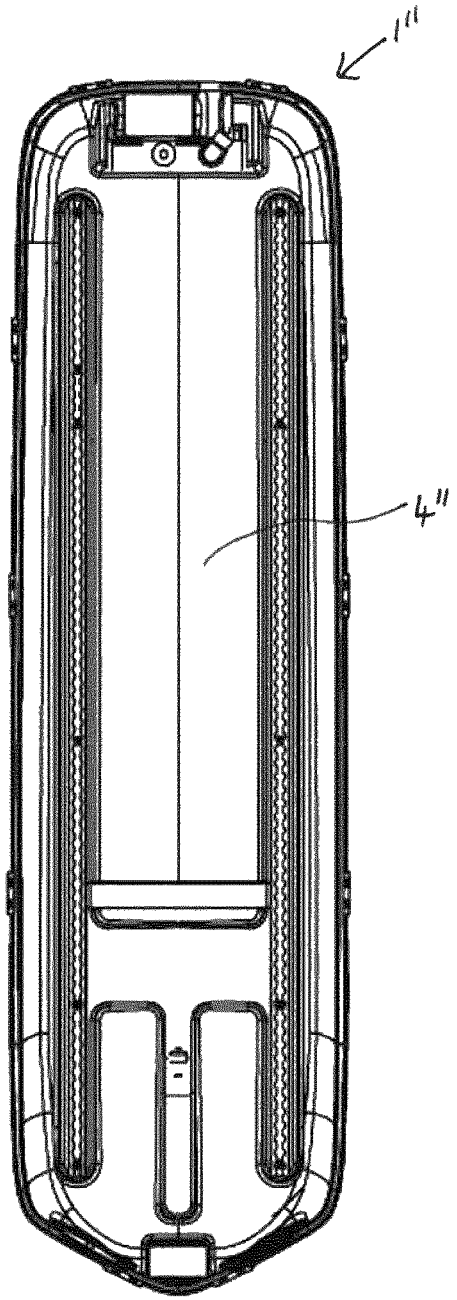
FIG. 8 is a bottom view of the third patient isolator.

As shown in the bottom view of FIG. 8 the patient isolator 1" may have means (e.g. L-tracks) to allow the base to be connected to a stretcher under carriage.

Figure 7:
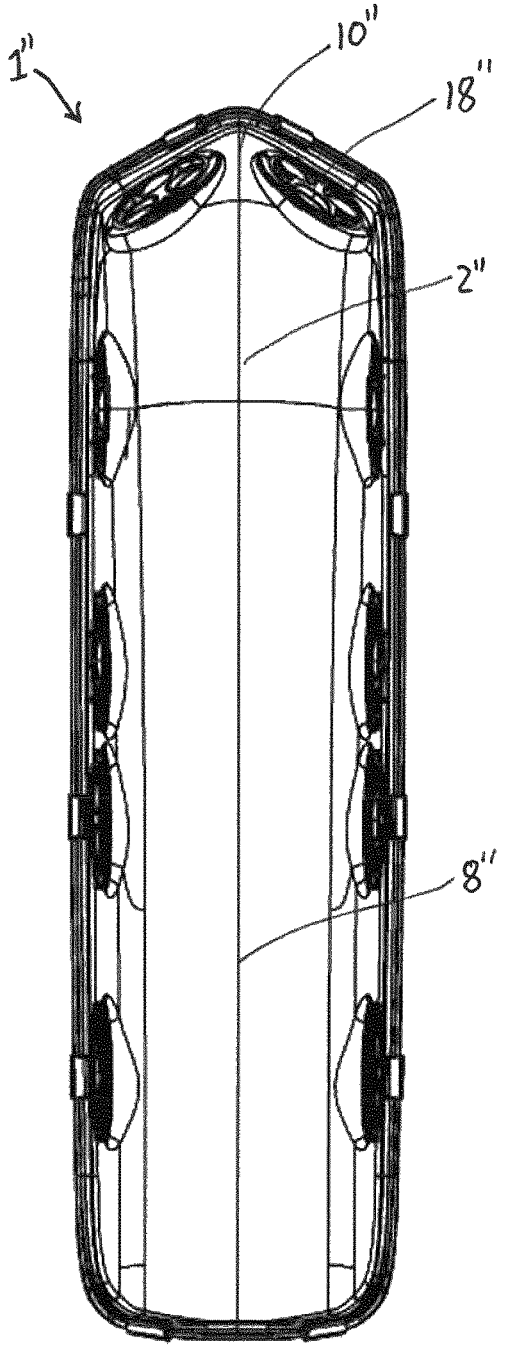
FIG. 7 is a top view of the third patient isolator.

As shown most clearly in FIG. 7, whilst the end face 10" may have flat portions for the access ports 18" on the end face, the end face may still be curved between the access ports 18".

Figure 9:
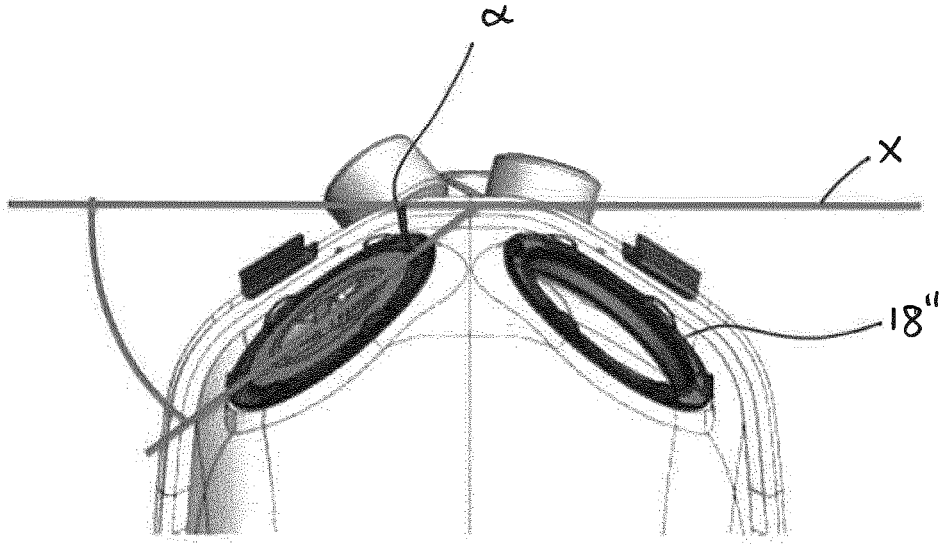
FIGS. 9 and 10 illustrate exemplary angles of access ports.

FIG. 9 shows that the access ports 18" on the end face may be angled by an angle $\alpha$ in a width direction relative to a plane x which extends parallel to the width and height direction of the patient isolator. $\alpha$ may for example be about 40 degrees. As illustrated, each of the access ports 18" may be angled relative to each other in a width direction relative to a plane x which extends parallel to the width and height direction of the patient isolator.

Figure 10:
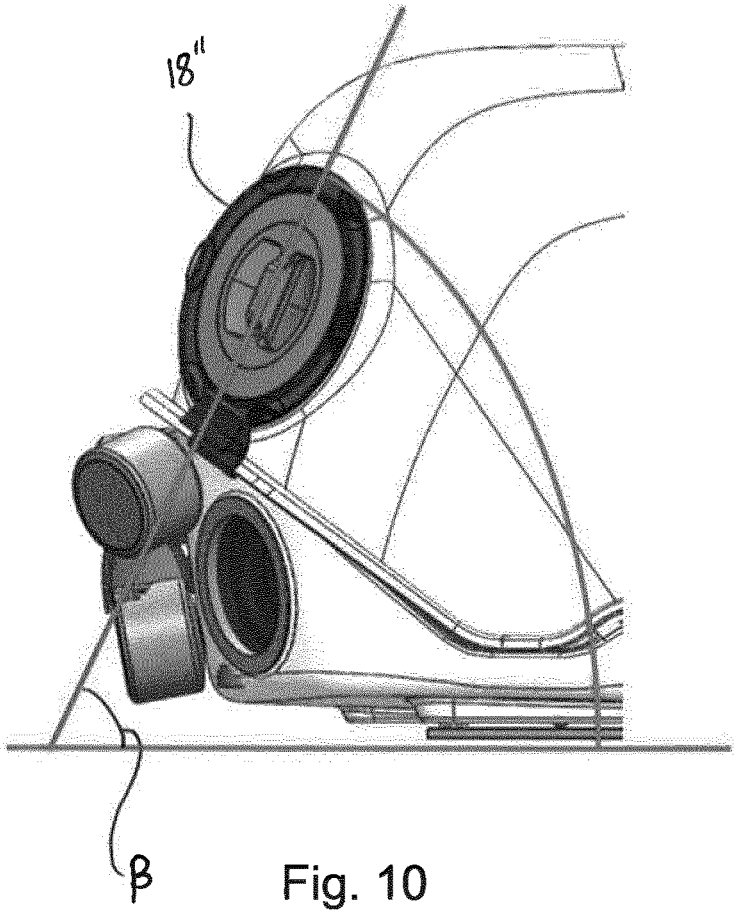

FIG. 10 shows that the access ports 18" on the end face may each be angled by an angle $\beta$ in vertical direction to the plane parallel with the horizontal bottom surface of the isolator. $\beta$ may for example be between 70 and 75 degrees.

Figure 11:
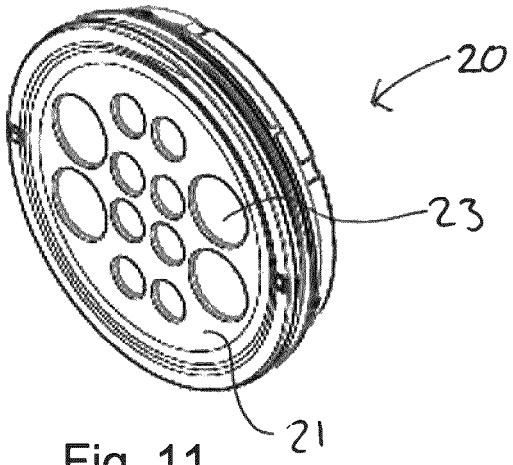
FIGS. 11 to 13 show views of a first line entry apparatus.
Figure 12:
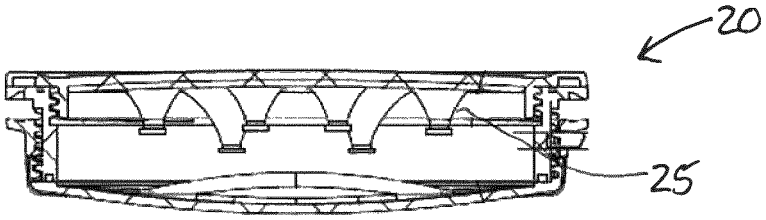
Figure 13:
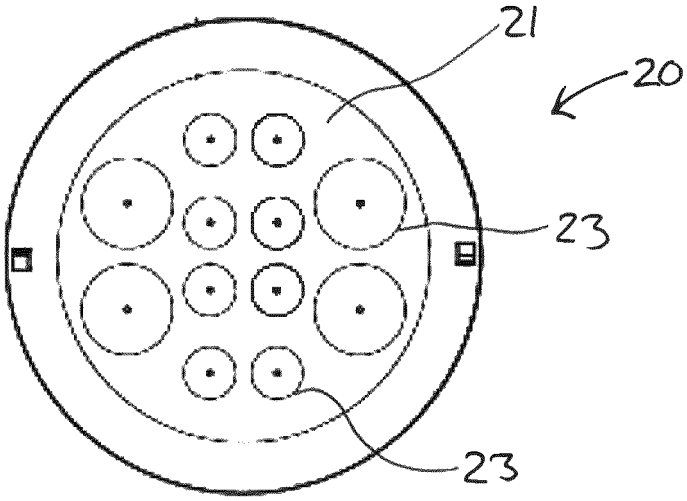

A first line entry apparatus 20 for lines entering the patient isolator 1 (or 1' or 1") is shown at FIGS. 11, 12 and 13.

The line entry apparatus 20 comprises a support 21 in the form of a rigid plate. The rigid plate 21 comprises a plurality of apertures 23 therethrough. The plurality of apertures 23 comprises larger sized apertures and smaller sized apertures. Associated with each aperture is a seal 25. The seal 25 is in the form of a conical elastic membrane which has small hole in it. In use, a line can pass through the hole in the seal 25 and be sealed about by the elastic membrane.

Figure 14:
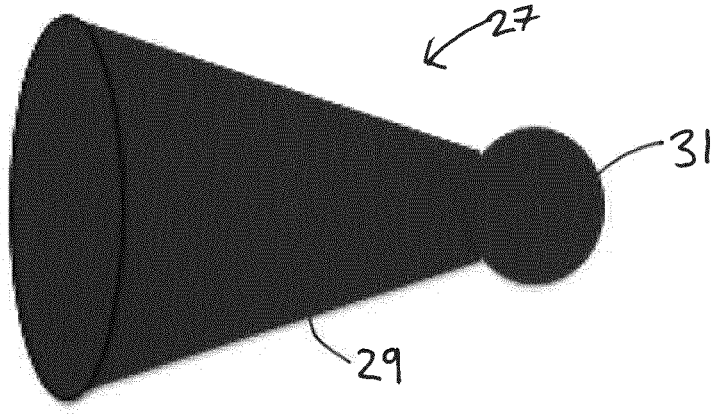
FIG. 14 is a schematic of a plug for use with the first line entry apparatus.

When a line does not pass through an aperture 23, the aperture may be sealed with a plug 27 (see for example FIG. 14). The plug 27 has a conical surface 29 which complements the shape of the conical seal 25. The plug 27 may also have a protuberance 31. The diameter of the protuberance 31 may be greater than the diameter of the hole in the seal 25. When the plug is located in the aperture 23 in engagement with the seal 25, the protuberance 31 can be located on the inside of the seal and act to hold the plug 27 in location.

Figure 15:
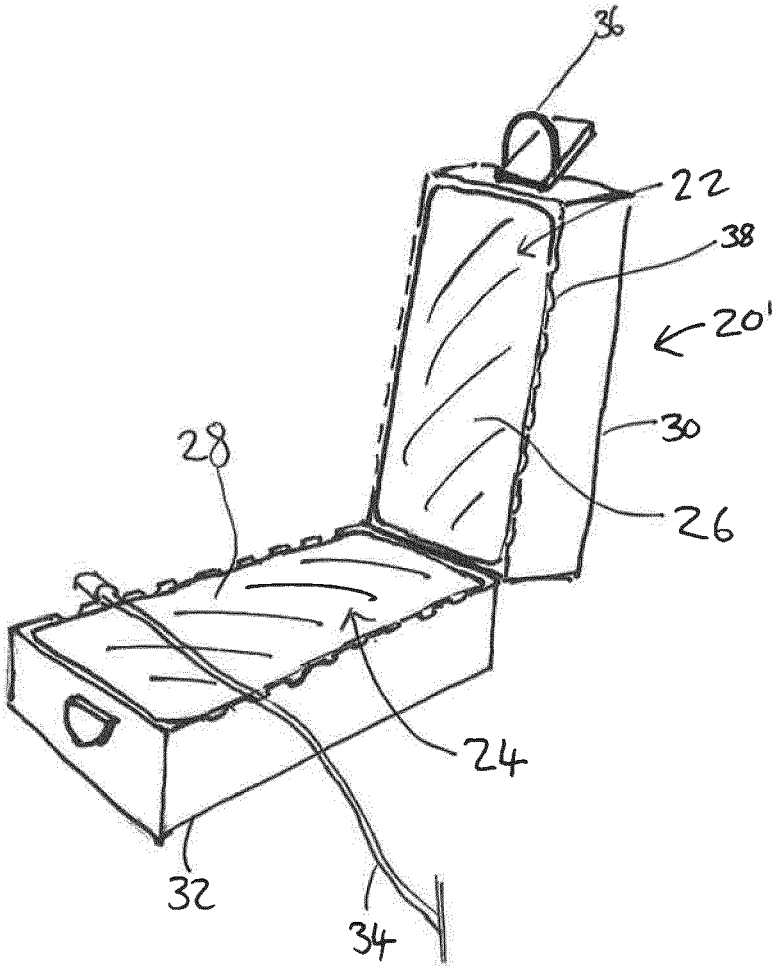
FIG. 15 shows a second line entry apparatus.

FIG. 15 shows an alternative line entry apparatus 20'. The line entry apparatus 20' comprises a first seal portion 22 (which in use may be a top seal portion) and a second seal portion 24 (which in use may be a bottom seal portion).

Figure 4:
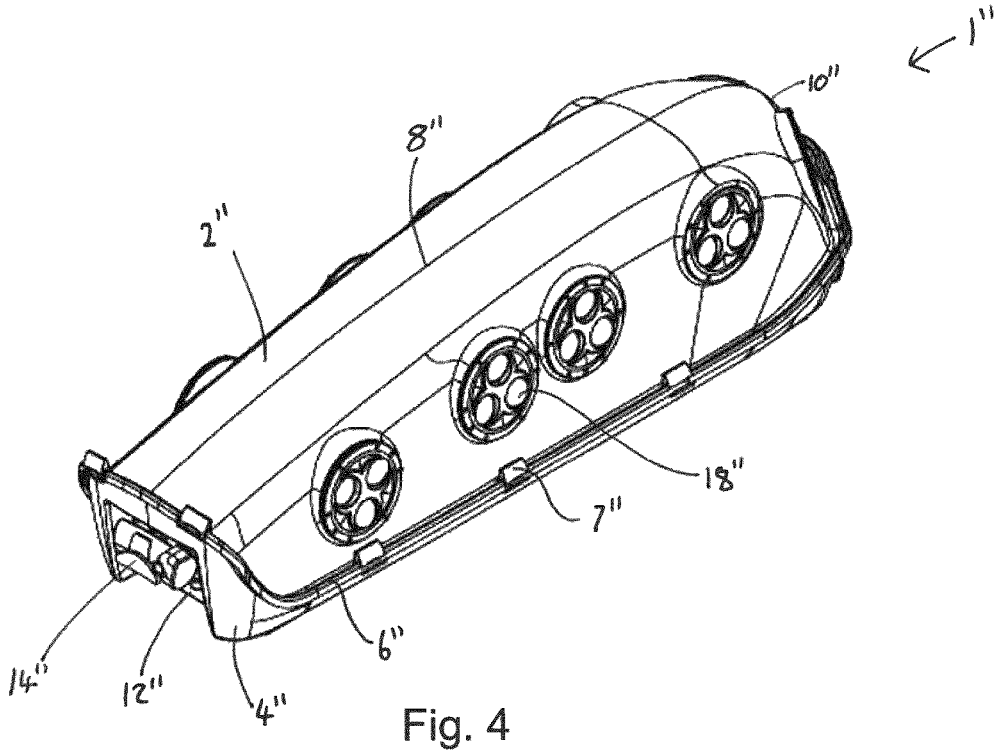
FIG. 4 is a perspective view of a third patient isolator.
Figure 5:
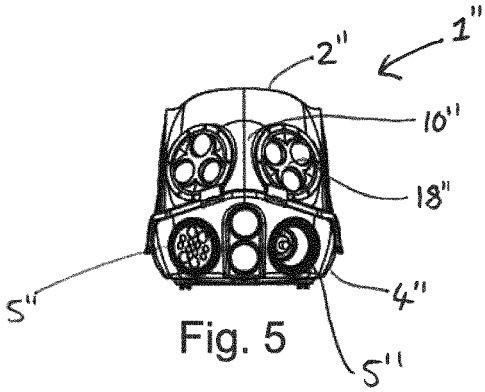
FIG. 5 is an end view of the third patient isolator.
Figure 6:
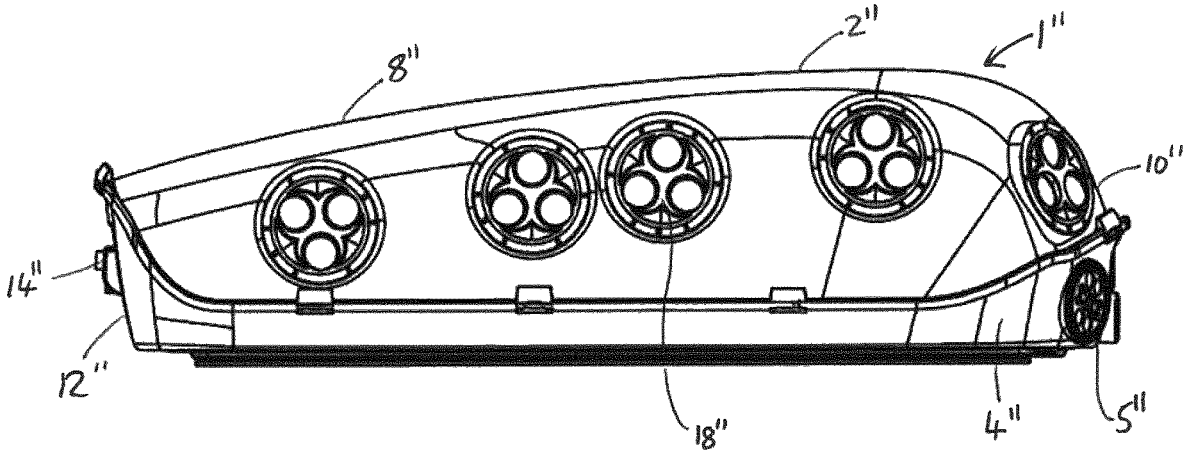
FIG. 6 is a side view of the third patient isolator.

The seal portions 22, 24 are connected together via a hinge and are movable between an open (assembly) position and a closed (sealing) position. The open, assembly position is shown in FIG. 4.

The first seal portion 22 has an elastic seal surface 26 and the second seal portion 24 has a second elastic seal surface 28. The first and second elastic seal surfaces 26, 28 can together form a seal.

The first and second elastic seal surfaces 26, 28 are each provided by a silicone pillow. Each silicone pillow is housed within a respective housing 30, 32. The housing 30, 32 is a rigid container which provides a support. The silicone pillows each protrude from their respective housing 30, 32 such that when the housings are urged together into the closed position the silicone pillows are compressed against each other to form a seal between the silicone pillows and around any lines 34 which are lying across the silicone pillows.

The line entry apparatus 20 comprises a fastener 36 which can be used to keep the two seal portions 22, 24 in contact with each other when in the closed position.

The housings 30, 32 when in the closed position form a wedge shape. This wedge shape is designed to be smaller in height in the surface that is nearest the inside of the patient isolator 1 (or 1' or 1") in use and greater in height in the surface that is nearest the outside of the patient isolator 1 in use. This wedge shape is so that a good seal can be formed between the line entry apparatus 20 and the patient isolator 1 when the line entry apparatus 20 is inserted into the patient isolator 1 from the external environment.

Each housing 30, 32 has a plurality of pairs of recesses 38 along opposing sides (i.e. one recess 38 of the pair is on one side and the other recess 38 of the pair is on the opposing side). This is for accommodating lines 34 which extend through the line entry apparatus 20 in use.

The recesses 38 on each of the housings 30, 32 are positioned so that they line up with a corresponding recess 38 on the other of the housings 30, 32. This is so that the recesses 38 form apertures when the line entry apparatus 20 is in the closed position through which the lines 34 can extend.

Figure 16:
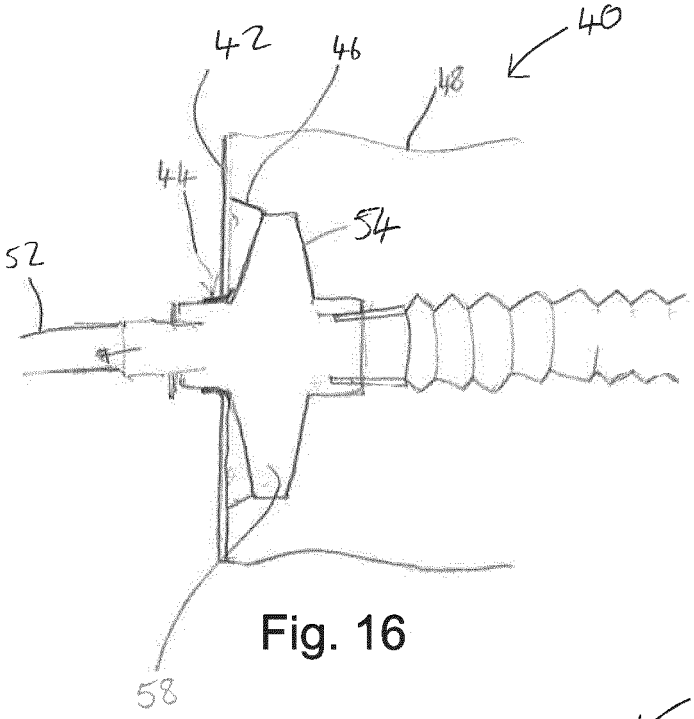
FIG. 16 shows a ventilator port.
Figure 17:
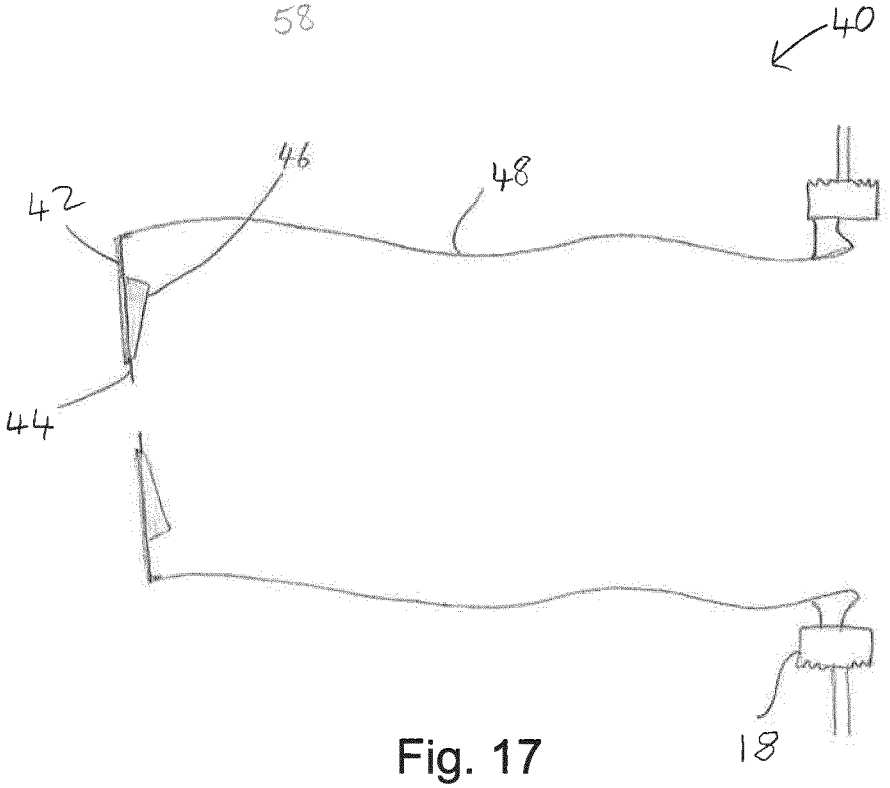
FIG. 17 shows the ventilator port in the extended position.
Figure 18:
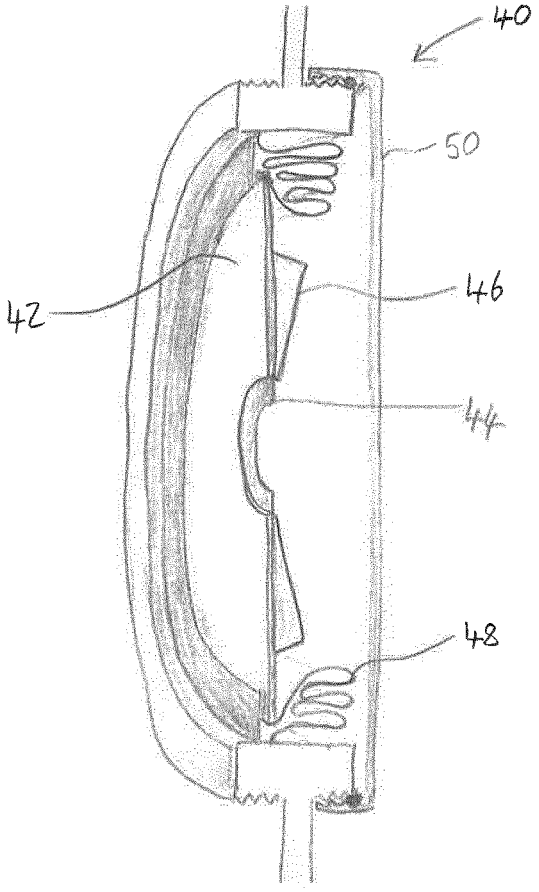
FIG. 18 shows the ventilator port in the retracted position.

FIGS. 16, 17 and 18 show a ventilator port 40.

The ventilator port 40 comprises a sealing surface 42. The sealing surface 42 comprises an aperture surrounded by an elastic ring 44. This elastic ring 44 has an inner diameter which is less than the outer diameter of the ventilator component which passes through the elastic ring 44. This is to provide a reliable seal between the ventilator port 40 and the ventilator filter as shown for example in FIG. 16.

The sealing surface 42 also comprises a seal annulus 46. This is an annulus 46 which extends around the aperture and elastic ring 44 of the sealing surface 42. The seal annulus 46 has a shape which corresponds to the portion of the ventilator it will be in contact with to allow a secondary seal to be formed. In the example shown in FIGS. 16 to 18 the seal annulus 46 has a wedge shaped cross section.

The ventilator port 40 comprises a flexible conduit 48. The flexible conduit 48 is connected at one end to an access port 18 and at the other end to the sealing surface 42. This flexible conduit 48 allows the sealing surface 42 to be moved between an extended position (as shown for example in FIG. 17) and a retracted position (as shown for example in FIG. 18).

The ventilator port 40 can comprise a cap 50. As shown in FIG. 18, this cap 50 can provide protection for the sealing surface 42 and flexible conduit 48 before the ventilator port 40 is used.

Figure 19:
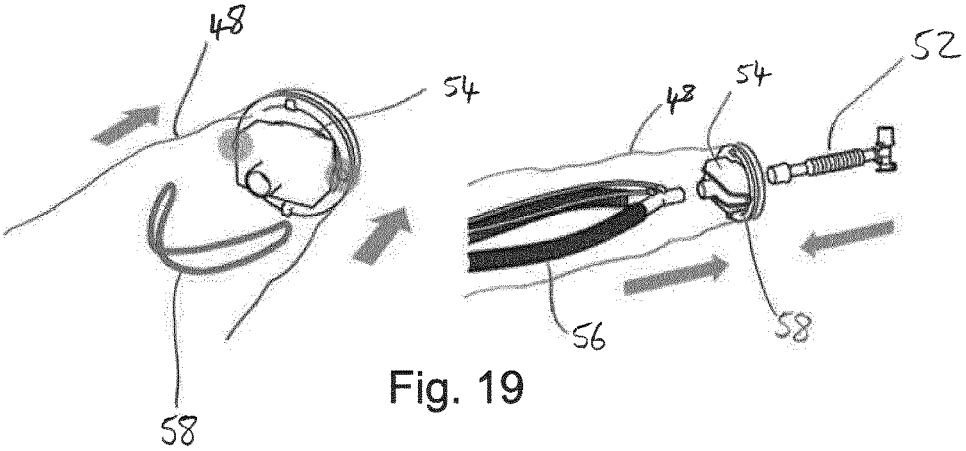
FIGS. 19 and 20 show further details of the ventilator port.
Figure 20:
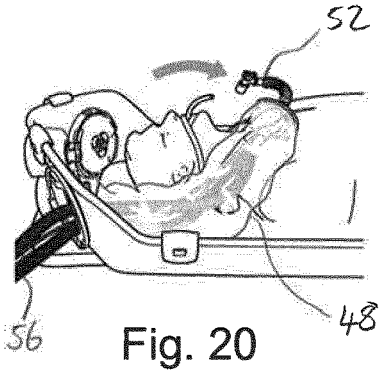
Figure 21:
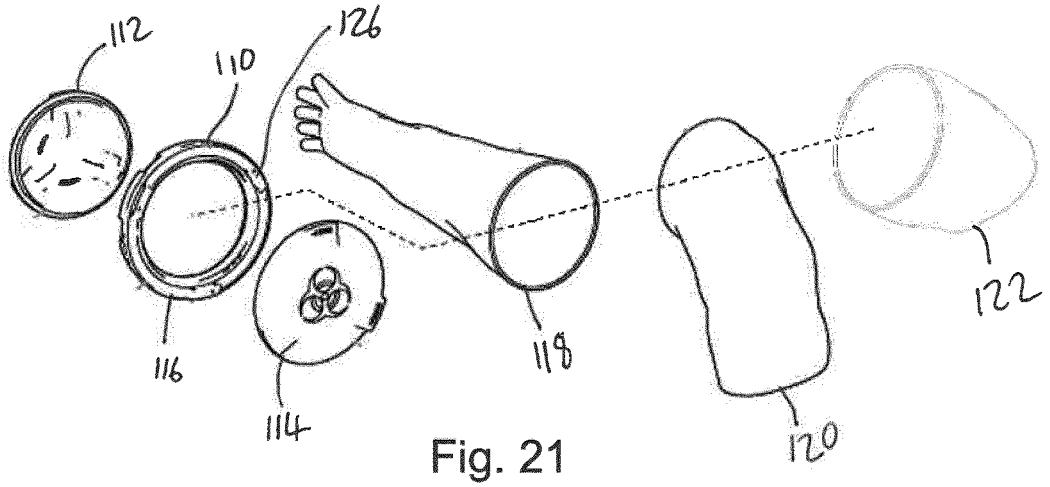
FIGS. 21 to 25 show details of the ports and how they may be used.

The ventilator port 40 may be connected to a ventilator as shown in FIGS. 16, 19 and 20. The ventilator may comprise an endotracheal (ET) tube 52 which is in the internal environment of the patient isolator 1, a filter 54 which connects to the ET tube 52. The main body of the filter 54 is located on the external side of the sealing surface 42 and a part of it extends through and seals with the elastic aperture 44. A face of the main body of the filter 54 engages with the seal annulus 46. The filter 54 may be affixed to the sealing surface by a fastener 58. Finally, the filter 54 may be connected to a ventilator hose 56 which leads back to a ventilator.

FIGS. 21 to 25 show more details of the ports 18 and 5.

In this example, each port 18, 5 comprises a pair of locking rings 110. The locking rings 110 sandwich the edge of the cover 2 or base 4 (depending on the location of the port 18, 5) and seal thereto. The two locking rings 110 sandwich the cover 2 or base 4.

The pair of locking rings 110 are screwed together through the cover 2 or base 4 of the patient isolator 1 and seal to each other and the patient isolator 1. One or more seals, such as an O-ring, may be located between each locking ring 110 and the patient isolator 1.

Each port 18, 5 may comprise a locking ring locking mechanism that secures the two locking rings 110 to each other to prevent inadvertent unaffixing of the locking rings 110 from the patient isolator 1.

Each port 5, 18 comprises two caps 112, 114. One cap is an internal cap 112 that in use is located on the inside of the patient isolator 1 and one cap is an external cap 114 that in use is located on the outside of the patient isolator 1.

The presence of both an internal and external cap 112, 114 allows equipment to be attached to a port to be changed, removed, or added whilst keeping the internal environment isolated from the external environment.

Each cap provides a hermetic closure of the port by being screwed onto an inner or outer surface of a port 18, 5.

The internal and external caps 112, 114 each have a handgrip on both sides, so the caps can be opened from either side.

The port 18, 5 also in certain cases comprise an affixing ring 116, for affixing and sealing equipment (such as a glove 118, waste bag 120, air-lock bag 120, ventilator port 40, line entry apparatus 20) to the port 18, 5. The affixing ring 116 screws onto the external locking ring 110. Equipment, such as a glove 118, waste port 120, air-lock bag 122 etc, may be sealed onto the affixing ring 116 and then affixed and sealed onto the patient isolator 1 by means of the affixing ring being screwed and sealed onto one of the locking rings 110.

Figure 22:
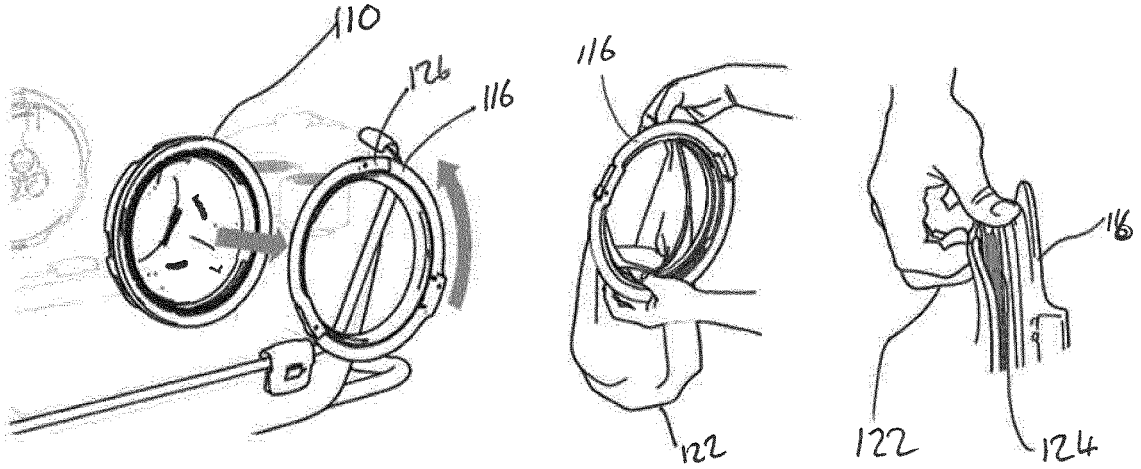
Figure 23:
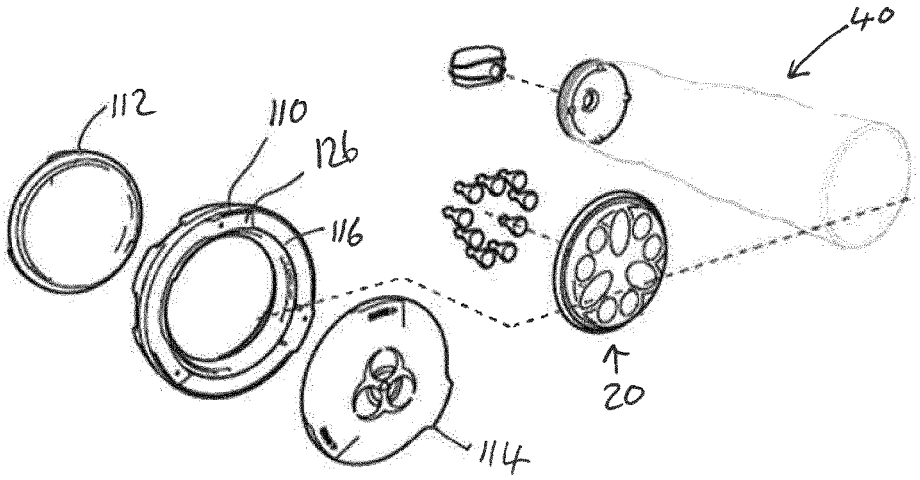
Figure 24:
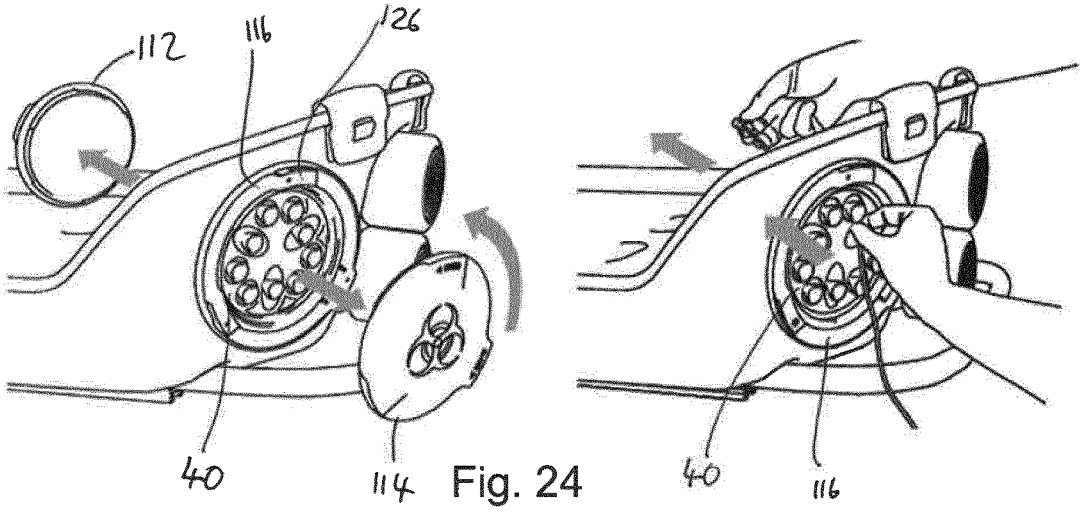
Figure 25:
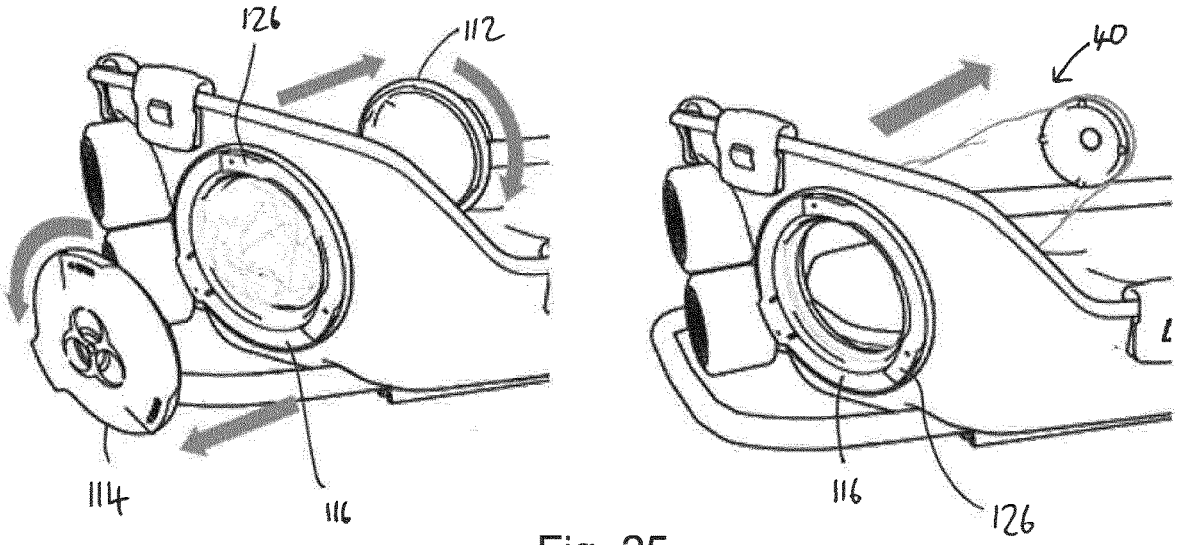

The equipment (such as glove 118, waste port 120, air-lock bag 122 etc) may be mounted around a lip/flange of the affixing ring, in a circumferential socket/recess 124 ash shown on the right-hand side of FIG. 22. When the affixing ring 116 is screwed into the "sandwich"-ring 110, the equipment is secured to the patient isolator 1. In this case the equipment also acts as a gasket between the affixing ring 116 and one of the locking rings 110.

Each affixing ring 116 may comprise an affixing ring locking mechanism 126. This can be used to avoid unwanted opening of the affixing ring 116 that holds the equipment. For example, as shown the affixing ring may comprise three clips 126 that have to be pushed down to allow the affixing ring 116 to be unscrewed from the patient isolator 1.

The base 4 of the patient isolator 1 has standardized mounting adapters (such as L-tracks) on the underside thereof. This allows the patient isolator 1 to be easily connected to a stretcher frame/undercarriage so that it can be wheeled and/or put into a vehicle such as an ambulance for transportation.

Figure 26:
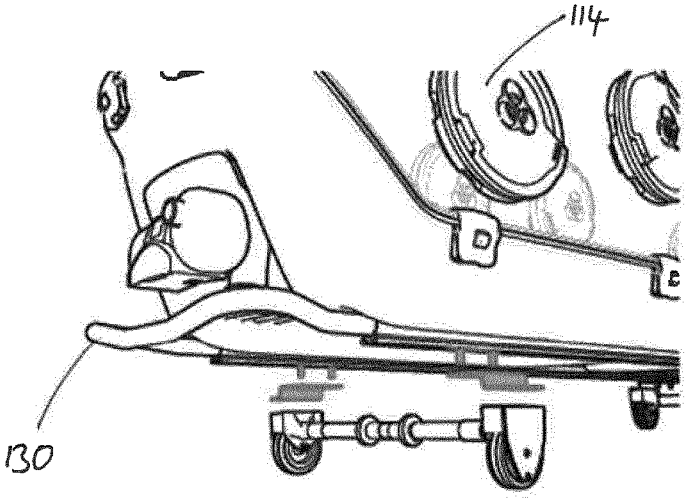
FIG. 26 shows details of the undercarriage and carrier handles.

The patient isolator 1 may comprise carrier handles 130 at the head and foot end. The carrier handles 130 are curved structures that are curved upwards as shown in FIG. 26 in order to allow the carrier's hands around it when the patient isolator is on the ground. The carrier handles 130 extend out beyond the head end and the foot end of the patient isolator 1. As such the carrier handles 130 may be arranged to help protect the equipment, such as filters, blower and other equipment in the head and foot end of the patient isolator 1. This is because the carrier handles 130 may act as the first point of contact if the patient isolator 1 hits in to another object or the ground.

The invention claimed is:

1. A patient isolator, the patient isolator comprising:
- a base; and
- a cover which is arranged to engage with the base to form a seal, wherein the seal is a hermetic seal,
- wherein the cover is formed from a rigid material,
- wherein the cover has two access ports on an end face,
- wherein the two access ports are each angled in a width direction relative to a plane which extends parallel to the width direction of the patient isolator,
- wherein the two access ports are angled relative to each other,
- wherein each access port is sealed so as to provide an airtight cover, and
- wherein the patient isolator is sealed such that, in use, the only flow of air between an inside and an outside of the isolator is filtered air.

2. A patient isolator according to claim 1, wherein the cover is transparent.

3. A patient isolator according to claim 1, wherein the cover has an end surface that is curved in both a horizontal direction and a vertical direction.

4. A patient isolator according to claim 1, wherein the cover has an upper surface which is curved in the width direction.

5. A patient isolator according to claim 1, wherein each access port is angled in the width direction at between 30 and 50 degrees relative to a plane which extends parallel to the width direction of the patient isolator.

6. A patient isolator according to claim 1, wherein the base has upwardly extending sides which form a rim which extends around the entire periphery of the base so as to form a tray.

7. A patient isolator according to claim 6, wherein the base provides a watertight container for collecting liquids.

8. A patient isolator according to claim 1, wherein the patient isolator comprises a plurality of clips for connecting the cover and the base.

9. A patient isolator according to claim 1, wherein the patient isolator comprises a bed that has independently adjustable leg and back portions.

10. A patient isolator according to claim 1, wherein the patient isolator is made from non-flammable materials.

11. A patient isolator according to claim 1, wherein the patient isolator comprises a protection cover that covers at least the external surfaces of at least one of the cover and the base before use.

12. A patient isolator according to claim 1, wherein the patient isolator comprises a second cover which is flexible, wherein the flexible cover is larger than the first cover, designed to enable the patient to stand up when in the patient isolator, and designed to be able to form a seal with the base.

13. A patient isolator according to claim 1, wherein the patient isolator comprises a line entry apparatus for providing a seal around a line entering the patient isolator, the line entry apparatus comprising:

a support; and a seal;

wherein the support comprises an aperture for a line to extend through, and wherein the seal is arranged so that, in use, when the line extends through the aperture, the seal will seal around the line.

14. A patient isolator according to claim 1, wherein the patient isolator comprises a ventilator port, the ventilator port comprising:

a sealing surface against which a part of a ventilator can seal, wherein the sealing surface is movable between an extended position and a retracted position.

15. A patient isolator according to claim 1, wherein the patient isolator comprises a line entry apparatus for providing a seal around a line entering the patient isolator, the line entry apparatus comprising:

a first portion, the first portion having a first elastic seal surface; and a second portion, the second portion having a second elastic seal surface;

wherein, in use, the first elastic seal surface is put in contact with the second elastic seal surface so as to form a seal between the first portion and the second portion and the line that extends through the seal across the first elastic seal surface and the second elastic seal surface.

16. A method of isolating a patient from an environment, the method comprising providing a patent isolator comprising a base, and a cover which is arranged to engage with the base to form a seal, wherein the seal is a hermetic seal, wherein the cover is formed from a rigid material, wherein the cover has two access ports on an end face, wherein the two access ports are each angled in a width direction relative to a plane which extends parallel to the width direction of the patient isolator, wherein each access port is sealed so as to provide an airtight cover, wherein the patient isolator is sealed such that, in use, the only flow of air between an inside and an outside of the isolator is filtered air, and wherein the two access ports are angled relative to each other;

placing a patient in the patient isolator; and sealing the patient isolator to isolate the patient from the environment.

* * * * *